US011654443B2

(12) United States Patent
Allen et al.

(10) Patent No.: US 11,654,443 B2
(45) **Date of Patent: *May 23, 2023**

(54) MINERAL PROCESSING

(71) Applicant: CiDRA Minerals Processing Inc., Wallingford, CT (US)

(72) Inventors: Warrick James David Allen, Hilversum (NL); Simon David Childs, Droitwich (GB); Andrea Duffy, Atherstone (GB); Nicholas Horrocks, Dusseldorf (DE); Elizabeth Lakin, Long Eaton (GB); Paul Edward Young Milne, Worcester (GB); James Leonard Rolfe, London (GB)

(73) Assignee: CIDRA MINERALS PROCESSING INC., Wallingford, CT (US)

( * ) Notice: Subject to any disclaimer, the term of this patent is extended or adjusted under 35 U.S.C. 154(b) by 132 days.

This patent is subject to a terminal disclaimer.

(21) Appl. No.: 16/834,406

(22) Filed: Mar. 30, 2020

(65) Prior Publication Data

US 2020/0316613 A1 Oct. 8, 2020

Related U.S. Application Data

(63) Continuation of application No. 14/344,490, filed as application No. PCT/GB2012/052269 on Sep. 13, 2012, now Pat. No. 10,603,676.

(30) Foreign Application Priority Data

Sep. 13, 2011 (GB) ..... 1115823

(51) Int. Cl.

| | |
|---|---|
| ***B03D 1/016*** | (2006.01) |
| ***B03D 1/012*** | (2006.01) |
| ***B03D 1/02*** | (2006.01) |
| ***B03D 1/008*** | (2006.01) |
| *B03D 1/014* | (2006.01) |
| *B03D 1/004* | (2006.01) |

(52) U.S. Cl.

CPC ..... *B03D 1/016* (2013.01); *B03D 1/008* (2013.01); *B03D 1/012* (2013.01); *B03D 1/023* (2013.01); *B03D 1/0046* (2013.01); *B03D 1/014* (2013.01); *B03D 2201/02* (2013.01); *B03D 2203/025* (2013.01)

(58) Field of Classification Search

CPC ..... B03D 1/016; B03D 1/008; B03D 1/012; B03D 1/023; B03D 2203/025; B03D 2201/02; B03D 1/014; B03D 1/0046

See application file for complete search history.

(56) References Cited

U.S. PATENT DOCUMENTS

| | | | | |
|---|---|---|---|---|
| 2,585,473 A | | 2/1952 | Kennedy | |
| 2,699,872 A | | 1/1955 | Kelsey | |
| 3,224,582 A | | 12/1965 | Macon et al. | |
| 3,912,693 A | | 10/1975 | Shimizu et al. | |
| 4,100,242 A | | 7/1978 | Leach | |
| 4,177,253 A | | 12/1979 | Davies et al. | |
| 4,235,562 A | | 11/1980 | Ribas | |
| 4,358,368 A | | 11/1982 | Hellsten et al. | |
| 4,363,749 A | | 12/1982 | Weiss et al. | |
| 4,532,032 A | | 7/1985 | Ng et al. | |
| 4,556,482 A | | 12/1985 | Najaraj | |
| 4,587,013 A | | 5/1986 | Nagaraj et al. | |
| 4,685,963 A | | 8/1987 | Saville | |
| 4,735,711 A | * | 4/1988 | Klimpel | B03D 1/012 252/61 |
| RE32,786 E | * | 11/1988 | Fu | B03D 1/012 252/61 |
| 4,888,106 A | | 12/1989 | Lipp et al. | |
| 4,902,765 A | | 2/1990 | Wang et al. | |
| 4,981,582 A | | 1/1991 | Yoon et al. | |
| 5,192,423 A | | 3/1993 | Duczmal et al. | |
| 5,756,622 A | | 5/1998 | Wang et al. | |
| 5,965,117 A | | 10/1999 | Howard, Jr. et al. | |
| 6,234,318 B1 | | 5/2001 | Breau et al. | |
| 6,312,603 B1 | | 11/2001 | Nishizawa | |
| 6,319,407 B1 | | 11/2001 | Maatta et al. | |
| 6,890,431 B1 | | 5/2005 | Eades et al. | |
| 7,264,728 B2 | | 9/2007 | Gibson et al. | |
| 7,641,863 B2 | | 1/2010 | Doktycz et al. | |
| 7,891,213 B2 | | 2/2011 | Bogdahn et al. | |

(Continued)

FOREIGN PATENT DOCUMENTS

| | | |
|---|---|---|
| CA | 1257765 | 7/1989 |
| CL | 35025 | 6/1985 |

(Continued)

OTHER PUBLICATIONS

Jorge Rubio et at., The process of separation of fine mineral particles by floating with hydrophobic polymeric carrier, International Journal of Mineral Processing, 37 (1993) 109-122 Elsevier Science Publishers B.V., Amsterdam (Year: 1992).*

(Continued)

*Primary Examiner* — Taiwo Oladapo

(74) *Attorney, Agent, or Firm* — Ware, Fressola, Maguire & Barber LLP

(57) ABSTRACT

According to the invention there is provided a method of processing a mixture of minerals including the steps of:

(a) providing a mixture of minerals which includes a metal containing mineral and one or more unwanted gangue minerals;

(b) achieving a contact between the mixture of minerals and polymeric material that includes a mineral binding moiety which selectively binds to the metal containing mineral; and (c) separating the gangue minerals and the polymeric material which has the metal containing mineral bound thereto.

26 Claims, No Drawings

(56) References Cited

U.S. PATENT DOCUMENTS

| | | | | |
|---|---|---|---|---|
| 2003/0104359 | A1 | 6/2003 | Cuthbertson et al. | |
| 2003/0225231 | A1 | 12/2003 | Hall | |
| 2004/0000523 | A1* | 1/2004 | Rosenberg | B01J 20/3242 210/660 |
| 2004/0173506 | A1 | 9/2004 | Doktycz et al. | |
| 2005/0029204 | A1 | 2/2005 | Schwartzkopf | |
| 2005/0155415 | A1 | 7/2005 | Kurkowski et al. | |
| 2006/0226051 | A1 | 10/2006 | Navarrette et al. | |
| 2006/0263516 | A1 | 11/2006 | Jones et al. | |
| 2007/0138065 | A1* | 6/2007 | Santos | B03D 1/016 209/166 |
| 2009/0061226 | A1 | 3/2009 | Banin et al. | |
| 2009/0173668 | A1 | 7/2009 | Duyvesteyn et al. | |
| 2009/0206040 | A1 | 8/2009 | Berg et al. | |
| 2009/0267275 | A1 | 10/2009 | Birken | |
| 2009/0301972 | A1 | 12/2009 | Hines et al. | |
| 2010/0059449 | A1 | 3/2010 | Grass et al. | |
| 2010/0072110 | A1 | 3/2010 | Gradek | |
| 2010/0200510 | A1 | 8/2010 | Domke et al. | |
| 2010/0279322 | A1 | 11/2010 | Tang et al. | |
| 2010/0294725 | A1 | 11/2010 | Bush et al. | |
| 2010/0300941 | A1 | 12/2010 | Domke et al. | |
| 2011/0114566 | A1 | 5/2011 | McCaw et al. | |
| 2011/0120919 | A1* | 5/2011 | Domke | B03C 1/015 209/7 |
| 2012/0029120 | A1 | 2/2012 | Soane et al. | |
| 2012/0076694 | A1 | 3/2012 | Morozov et al. | |
| 2012/0091000 | A1 | 4/2012 | Taylor et al. | |
| 2012/0228413 | A1 | 9/2012 | Rieger et al. | |

FOREIGN PATENT DOCUMENTS

| | | | |
|---|---|---|---|
| CL | 37162 | 2/1990 | |
| CL | 40165 | 5/1998 | |
| EP | 0348620 | 1/1990 | |
| EP | 1184064 | 3/2002 | |
| WO | 0006533 | 2/2000 | |
| WO | 0006610 | 2/2000 | |
| WO | 0006658 | 2/2000 | |
| WO | 0136510 | 5/2001 | |
| WO | 0140874 | 6/2001 | |
| WO | 0174919 | 10/2001 | |
| WO | 02066168 | 8/2002 | |
| WO | 2004064997 | 8/2004 | |
| WO | 2007012860 | 2/2007 | |
| WO | 2008001102 | 1/2008 | |
| WO | 2009063211 | 5/2009 | |
| WO | 2010007157 | 1/2010 | |
| WO | WO-2010007157 A1 * | 1/2010 | B03C 1/015 |
| WO | 2011058039 | 5/2011 | |

OTHER PUBLICATIONS

Brown et al. Magnetic Control over Liquid Surface Properties with Responsive Surfactants. Angew. Chem. Int. Ed. 51: 1-4, 2012 (retrieved on Jun. 4, 2013). Retrieved from the Internet. <URL: http://www.magneticmicrosphere.com/ckfinder/userfiles/files/Brown_magnetic_detergent_2012.pdf>. entire document.

English Language Abstract of EP0348620A2.

Rubio, J. and Hoberg, H.,The process of separation of fine mineral particles by flotation with hydrophobic polymeric carrier. Int. J.Miner. Process., 37:109-122, 1993.

Wyss et al. "A novel approach for the extraction of herbicides and pesicides from water using liquid-core microcapsules" by Wyss et al. Biotechnology and Engineering; Aug. 19, 2004; abstract, 3 pages.

Krishna et al. "Synthesis of xanthate functionalized silica gel and its application for the preconcentration and separation of uranium (VI) from inorganic components." Journal of Radioanalytical and Nuclear Chemistry. vol. 266, No. 2 (2005) 251-257.

Brown et al. Magnetic Control over Liquid Surface Properties with Responsive Surfactants. Angew. Chem. Int. Ed. 51: 1-4, 2012 (retrieved on Apr. 6, 2013). Retrieved from the Internet. <URL: http://www.magneticmicrosphere.com/ckfinder/userfiles/files/Brown_magnetic_detergent_2012.pdf>. entire document.

* cited by examiner

MINERAL PROCESSING

This application is a continuation application of, and claims benefit to, patent application Ser. No. 14/344,490, filed 30 Nov. 2015, which corresponds to international patent application serial no. PCT/GB2012/052269, filed 13 Sep. 2012, which claims benefit to GB 1115823.5, filed 13 Sep. 2011, which are all incorporated by reference in their entirety.

This invention relates to a method of processing a mixture of minerals, with particular reference to the separation of a metal containing mineral from unwanted gangue minerals. The invention also relates to certain novel polymers.

A ubiquitous problem in the field of mineral processing is the separation of valuable mineral content (values) from the mineral poor content (the gangues). By far the most widely used technique is the long established method of flotation (Wills' Mineral Processing Technology, $7^{th}$ Edition, Eds. B A Wills and T Napier-Munn, Butterworth-Heinemann, 2006, the entire contents of which are herein incorporated by reference). Mineral ore is finely ground and introduced to a flotation cell as a pulp comprising the particulate ore in water. 'Collector' chemicals are added to the pulp which adsorb on to mineral surfaces, rendering them hydrophobic. The pulp is aerated so as to produce air bubbles in the flotation cell which rise to the surface of the pulp to form a froth. The presence of the collector chemical is vital because it selectively adsorbs on to the surface of the values, rendering the values particles hydrophobic and thereby facilitating attachment to the bubbles. The values which are attached to the air bubbles are transported to the froth layer. Therefore, separation of the values from the gangues is achieved by the establishment of a froth which is rich in the values particles and can be readily separated from the pulp.

Although the flotation technique has for many years been the dominant separation technique, particularly for on site separation of ore at mines, there are numerous areas where it would be desirable to provide certain improvements. Because of the value of the ultimate products, even a small improvement in recovery yields results in very significant economic advantages. The recovery yield for flotation processes is dependent on the size of the ground ore particles. In particular, the recovery yields decrease as particle size increases above an optimal value. This optimal value depends on the nature of the ore and the precise flotation utilised, but for the extraction of copper from chalcopyrite ore the optimal particle size will likely be in the range 80 to 150 microns. Without wishing to be bound by any particular theory or conjecture, it is possible that this effect is gravitational in nature, owing to the weight of larger ore particles overcoming the adhesive forces between the particle and the bubble. Irrespective of its cause, it would be desirable to provide a means of recovering particles of larger sizes with increased efficiency. Another consideration is that the recovery of the material from the pulp by flotation can consist of three different mechanisms, one of which is the selective attachment of values to the air bubbles using collector chemicals (also known as 'true flotation'). Other possible mechanisms are entrainment in water that passes through the froth, and 'aggregation', or physical entrapment between particles in the froth which are attached to air bubbles. The entrainment and aggregation mechanisms can result gangue materials being recovered in the froth, and it is common for this to preclude the use of a single flotation stage, with several stages of flotation often being required. Another consideration is that it is typical to recover metal from a metal rich mineral after flotation by smelting. This results in the destruction of the collector chemicals. It would be desirable to provide a method in which the materials used for separation can be recovered rather than destroyed.

The present invention, in at least some of its embodiments, is directed to the above described problems and considerations. The present invention offers the possibility of integration into an existing flotation process, or implementation in other ways.

According to a first aspect of the invention there is provided a method of processing a mixture of minerals including the steps of:

(a) providing a mixture of minerals which includes a metal containing mineral and one or more unwanted gangue minerals;

(b) achieving a contact between the mixture of minerals and polymeric material that includes a mineral binding moiety which selectively binds to the metal containing mineral; and (c) separating the gangue minerals and the polymeric material which has the metal containing mineral bound thereto.

Advantageously, the metal containing mineral contains copper. Examples of copper containing minerals which may be processed by the invention include chalcopyrite and bornite.

Alternatively, the metal containing mineral may contain at least one of: lithium, zinc, iron, gold, silver, molybdenum, cobalt, platinum, uranium, other precious metals, other rare metals, arsenic, mercury, cadmium, tellurium, and lead.

The mineral binding moiety may contain at least one sulphur atom.

In certain embodiments the polymeric material includes a polymer which encapsulates the mineral binding moiety. For the avoidance of doubt, the term 'encapsulates' as used herein is not restricted to complete encasement of the mineral binding moiety within a polymeric matrix. Rather, the term includes reference to polymers which partially encases or otherwise constrains the mineral binding moiety within a polymeric matrix to leave at least some of the mineral binding moiety exposed at a surface of the polymer. Without wishing to be bound by any particular theory or conjecture, it is believed that such 'liberated' mineral binding moieties can be particularly effective at binding to metal containing minerals in particulate ore. Preferably, the encapsulated mineral binding moiety is a mineral collector chemical of the type known or suitable for use in traditional floatation processes. Classes of mineral binding moieties include thio, sulphate, sulphonate or carboxylic compounds or anions. Thio compounds or anions are particularly preferred, and examples include xanthate, dithiophosphate, thiophosphate, dithiocarbamate; thionocarbamate, dithiophosphinate, thiophosphinate, xanthogen formate, thiocarbanilide (diphenylthiourea) or thiol compounds or anions. Further information on mineral collector chemicals which might be utilised in the present invention can be found in Wills' Mineral Processing Technology, $7^{th}$ Edition, ibid, and DE Nagaraj, Cl Basilio and RH Yoon, $118^{th}$ SME/AIME Annual Meeting, Feb. 27-Mar. 2, 1989, the entire contents of which are herein incorporated by reference.

In other embodiments the polymeric material is a polymeric structure having repeat units which incorporate the mineral binding moiety. The mineral binding moiety may include at least one functional group selected from amine, thiol, ester, crown ether, aza-crown ether, organic acid, porphyrin, thiocycloalkane, urea, thiourea, phthalocyanine, thionocarbamate, thiophosphate or xanthogen formate. For the avoidance of doubt, the terms 'thiourea' and 'thionourea' used herein refer to the same moiety.

Numerous polymeric materials may be used. The polymeric material may include a polymer formed by polymerising a polymeric precursor which includes a group of sub-formula (I)

[I]

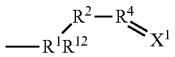

where $R^1$ is i) $CR^a$, where $R^a$ is hydrogen or alkyl, ii) a group $N^+R^3(Z^{m-})_{1/m}$, $S(O)_pR^{14}$, or $SiR^5$ where $R^{13}$ is hydrogen, halo, nitro, or hydrocarbyl, optionally substituted or interposed with functional groups, $R^{14}$ and $R^{15}$ are independently selected from hydrogen or hydrocarbyl, Z is an anion of charge m, p is 0, 1 or 2 and q is 1 or 2, iii) C(O)N,N, $S(O)_2N$, C(O)ON $CH_2ON$, or CH═CHR$^c$N where $R^c$ is an electron withdrawing group, or iv) OC(O)CH, C(O)OCH or $S(O)_2CH$; in which $R^{12}$ is selected from hydrogen, halo, nitro, hydrocarbyl, optionally substituted or interposed with functional groups, or —$R^3$—$R^5$═$Y^1$.

$R^2$ and $R^3$ are independently selected from $(CR^7R^8)_n$, or a group $CR^9R^{10}$, $CR^7R^8CR^9R^{10}$ or $CR^9R^{10}CR^7R^8$ where n is 0, 1 or 2, $R^1$ and $R^8$ are independently selected from hydrogen or alkyl, and either one of $R^9$ or $R^{10}$ is hydrogen and the other is an electron withdrawing group, or $R^9$ and $R^{10}$ together form an electron withdrawing group;

$R^4$ and $R^5$ are independently selected from CH or $CR^{11}$ where $CR^{11}$ is an electron withdrawing group, the dotted lines indicate the presence or absence of a bond, $X^1$ is a group $CX^2X^3$ where the dotted line bond to which it is attached is absent and a group $X^2$ where the dotted line to which it is attached is present, $Y^1$ is a group $CY^2Y^3$ where the dotted line to which it is attached is absent and a group $CY^2$ here the dotted line to which it is attached is present, and $X^2$, $X^3$, $Y^2$ and $Y^3$ are independently selected from hydrogen, fluorine or other substituents.

For the avoidance of doubt, the term 'polymeric precursor' includes reference to monomers, and also to prepolymers obtained by partial or pre-polymerisation of one or more monomers.

Polymers of this type can successfully incorporate mineral binding moieties in a number of ways, can be easily polymerised and processed, and exhibit a number of useful properties.

Preferably, the polymeric precursor is polymerised by exposure to ultraviolet radiation. Alternative polymerisation methods include the application of heat (which may be in the form of IR radiation), where necessary in the presence of an initiator, by the application of other sorts of initiator such as chemical initiators, or by initiation using an electron beam. The expression "chemical initiator" as used herein refers to compounds which can initiate polymerisation such as free radical initiators and ion initiators such as cationic or anionic initiators as are understood in the art. Radiation or electron beam induced polymerisation is suitably effected in the substantial absence of a solvent. As used herein, the expression "in the substantial absence of solvent" means that there is either no solvent present or there is insufficient solvent present to completely dissolve the reagents, although a small amount of a diluent may be present to allow the reagents to flow.

In the preferred embodiments in which the monomer is polymerised by exposure to ultraviolet radiation, polymerisation may take place either spontaneously or in the presence of a suitable initiator. Examples of suitable initiators include 2, 2'-azobisisobutyronitrle (AIBN), aromatic ketones such as benzophenones in particular acetophenone; chlorinated acetophenones such as di- or tri-chloracetophenone; dialkoxyacetophenones such as dimethoxyacetophenones (sold under the trade name "Irgacure 651") dialkylhydroxyacetophenones such as dimethylhydroxyacetophenone (sold under the trade name "Darocure 1173"); substituted dialkylhydroxyacetophenone alkyl ethers such compounds of formula

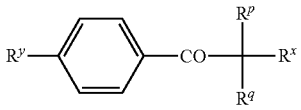

where $R^y$ is alkyl and in particular 2, 2-dimethylethyl, $R^x$ is hydroxyl or halogen such as chloro, and $R^p$ and $R^q$ are independently selected from alkyl or halogen such as chloro (examples of which are sold under the trade names "Darocure 1116" and "Trigonal P1"); 1-benzoylcyclohexanol-2 (sold under the trade name "Irgacure 184"); benzoin or derivatives such as benzoin acetate, benzoin alkyl ethers in particular benzoin butyl ether, dialkoxybenzoins such as dimethoxybenzoin or deoxybenzoin; dlbenzyl ketone; acyloxime esters such as methyl or ethyl esters of acyloxime (sold under the trade name "Quantaqure PDO"); acylphosphine oxides, acylphosphonates such as dialkylacylphosphonate, ketosulphides for example of formula

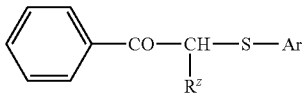

where $R^z$ is alkyl and Ar is an aryl group; dibenzoyl disulphides such as 4, 4'-dialkylbenzoydisuphide; diphenyldithiocarbonate; benzophenone; 4, 4-bis (N, N-dialkyamino) benzophenone; fluorenone; thioxanthone; benzil; or a compound of formula

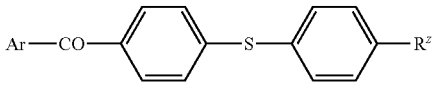

where Ar is an aryl group such as phenyl and $R^2$ is alkyl such as methyl (sold under the trade name "Speedcure BMDS").

As used herein, the term "alkyl" refers to straight or branched chain alkyl groups, suitably containing up to 20 and preferably up to 6 carbon atoms. The term "alkyl" as used herein is understood to include reference to polyvalent radicals, such as divalent alkylene radicals, as well as monovalent radicals. The terms "alkenyl" and "alkynyl" refer to unsaturated straight or branched chains which include for example from 2-20 carbon atoms, for example from 2 to 6 carbon atoms. Chains may include one or more double to triple bonds respectively. In addition, the term "aryl" refers to aromatic groups such as phenyl or naphthyl.

The term "hydrocarbyl" refers to any structure comprising carbon and hydrogen atoms. For example, these may be alkyl, alkenyl, alkynyl, aryl such as phenyl or napthyl, arylalkyl, cycloalkyl, cycloalkenyl or cycloalkynyl. Suitably they will contain up to 20 and preferably up to 10 carbon atoms. The term "heterocylyl" includes aromatic or non-aromatic rings, for example containing from 4 to 20, suitably from 5 to 10 ring atoms, at least one of which is a heteroatom such as oxygen, sulphur or nitrogen. Examples of such groups include furyl, thienyl, pyrrolyl, pyrrolidinyl, imidazolyl, triazolyl, thiazolyl, tetrazolyl, oxazolyl, isoxazolyl, pyrazolyl, pyridyl, pyrimidinyl, pyrazinyl, pyridazinyl, triazinyl, quinolinyl, isoquinolinyl, quinoxalinyl, benzthiazolyl, benzoxazolyl, benzothienyl or benzofuryl.

The term "functional group" refers to reactive groups such as halo, cyano, nitro, oxo, $C(O)_nR^a$, $OR^a$, $S(O)_tR^a$, $NR^bR^c$, $OC(O)NR^bR^c$, $C(O)NR^bR^c$, $OC(O)\ NR^bR^c$, $—NR^7(C(O)_nR^6$, $—NR^aCONR^bR^c$, $—C{=}NOR^a$, $—N{=}CR^bR^c$, $S(O)_tNR^bR^c$, $C(S)_nR^a$, $C(S)OR^a$, $C(S)NR^bR^c$ or $—NR^bS(O)_tR^a$ where $R^a$, $R^b$ and $R^c$ are independently selected from hydrogen or optionally substituted hydrocarbyl, or $R^b$ and $R^c$ together form an optionally substituted ring which optionally contains further heteroatoms such as $S(O)_s$, oxygen and nitrogen, n is an integer of 1 or 2, t is 0 or an integer of 1-3. In particular, the functional groups are groups such as halo, cyano, nitro, oxo, $C(O)_nR^a$, $OR^a$, $S(O)_tR^a$, $NR^bR^c$, $OC(O)NR^bR^c$, $C(O)NR^bR^c$, $OC(O)NR^bR^c$, $—NR^7C(O)_nR^6$, $—NR^aCONR^bR^c$, $—NR^aCSNR^bR^c$, $C{=}NOR^a$, $—N{=}CR^bR^c$, $S(O)_tNR^bR^c$, or $—NR^bS(O)_tR^a$ where $R^a$, $R^b$ and $R^c$, n and t are as defined above.

The term "heteroatom" as used herein refers to non-carbon atoms such as oxygen, nitrogen or sulphur atoms. Where the nitrogen atoms are present, they will generally be present as part of an amino residue so that they will be substituted for example by hydrogen or alkyl.

The term "amide" is generally understood to refer to a group of formula $C(O)NR^aR^b$ where $R^a$ and $R^b$ are hydrogen or an optionally substituted hydrocarbyl group. Similarly, the term "sulphonamide" will refer to a group of formula $S(O)_2NR^aR^b$. Suitable groups $R^a$ include hydrogen or methyl, in particular hydrogen.

The nature of any electron withdrawing group or groups additional to the amine moiety used in any particular case will depend upon its position in relation to the double bond it is required to activate, as well as the nature of any other functional groups within the compound. The term "electron withdrawing group" includes within its scope atomic substituents such as halo, e.g. fluro, chloro and bromo, and also molecular substituents such as nitrile, trifluoromethyl, acyl such as acetyl, nitro, or carbonyl.

In the group of sub-formula (I), $X^1$ and, where present, $Y^1$ preferably represents $CX^2X^3$ and $CY^2Y^3$ respectively, and the dotted bonds are absent.

Preferably $R^{14}$ and $R^{15}$, when present, are alkyl groups, most preferably $C_1$ to $C_3$ alkyl groups.

Advantageously, $R^c$, when present, is a carbonyl group or phenyl substituted at the ortho and/or para positions by an electron withdrawing substituent such as nitro.

When $R^1$ is $CH{=}CHR^dNR^{16}—$, $R^d$ may be a carbonyl group or phenyl substituted at the ortho and/or para positions by an electron withdrawing substituent such as nitro.

Preferably, $R^7$ and $R^8$ are independently selected from fluoro, chloro or alkyl or H. In the case of alkyl, methyl is most preferred.

Preferably, $X^2$, $X^3$, $Y^2$ and $Y^3$ are all hydrogen.

It is possible that at least one, and possibly all, of $X^2$, $X^3$, $Y^2$ and $Y^3$ is a substituent other than hydrogen or fluorine. Preferably at least one, and possible all, of $X^2$, $X^3$, $Y^2$ and $Y^3$ is an optionally substituted hydrocarbyl group. In such embodiments, it is preferred that at least one, and most preferably all, of $X^2$, $X^3$, $Y^2$ and $Y^3$ is an optionally substituted alkyl group. Particularly preferred examples are $C_1$ to $C_4$ alkyl groups, especially methyl or ethyl. Embodiments in which $X^2$, $X^3$, $Y^2$ and/or $Y^3$ are alkyl groups are able to polymerise when exposed to radiation without the presence of an initiator. Alternatively, at least one, and preferably all, of $X^2$, $X^3$, $Y^2$ and $Y^3$ are aryl and/or heterocyclic, such as pyridyl, pyrimidinyl, or a pyridine or pyrimidine containing group.

In preferred embodiments, $R^{12}$ is $—R^3—R^5{=}Y^1$, $X^1$ and $Y^1$ are groups $CX^2X^3$ and $CY^1Y^2$ respectively and the dotted lines represent an absence of a bond. In these embodiments, the polymerisation may proceed by a cyclopolymerisation reaction.

A preferred group of polymeric precursors for use in the method of the invention are compounds of formula (II)

[II]

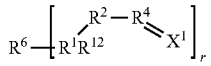

where r is an integer of 1 or more and $R^6$ is one or more of a bridging group, an optionally substituted hydrocarbyl group, a perhaloalkyl group, a siloxane group, an amide, or a partially polymerised chain containing repeat units.

Preferably, r is 1, 2, 3 or 4. Most preferably, r is 1 or 2.

Advantageously, the polymeric precursor is a compound of structure (Ill)

[III]

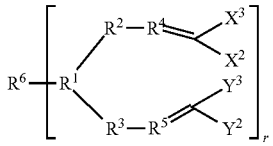

Where in the compounds of formula (II), r is 1, compounds can be readily polymerised to form a variety of polymer types depending upon the nature of the group $R^6$.

Where in the compounds of formula (II), r is greater than one, polymerisation can result in polymer networks. On polymerisation of these compounds, networks are formed whose properties may be selected depending upon the precise nature of the $R^6$ group, the amount of chain terminator present and the polymerisation conditions employed. Some examples of bridging groups can be found in WO 00/06610.

Preferably, $R^6$ comprises a straight or branched chain hydrocarbyl group, optionally substituted or interposed with functional groups. Advantageously, $R^6$ is a straight or branched chain alkyl group having 1 to 30 carbon atoms, optionally substituted or interposed with functional groups. Preferably, $R^6$ has between two and twenty carbon atoms, preferably between two and twelve carbon atoms.

In other embodiments, $R^{15}$ is hydrogen or hydrocarbyl, and thus the compound of formula (I) does not include the group $—R^3—R^5{=}Y^1$.

International Publications WO00/06610, WO00/06533, WO00/06658, WO01/36510, WO01/40874, WO01/74919 and WO2008/001102, the entire contents of all of which are herein incorporated by reference, disclose a class of polymers obtained from the polymerisation of a number of compounds which possess one or more dienyl groups.

International publication WO 01/74919 also discloses polymers formed from quaternary ammonium species having a single vinyl type group.

One way in which the polymeric material can include the mineral binding moiety is through polymerisation of a polymeric precursor which incorporates the mineral binding moiety within its structure. With polymeric precursors based upon sub-formula (I), this can be achieved by utilising polymeric precursors wherein $R^6$ is substituted or interposed with the mineral binding moiety.

$R^6$ may be substituted or interposed with at least one functional group selected from an amine, thiol, ester, crown ether, aza-crown ether, organic acid, porphyrin, thiocycloalkane, urea, thiourea, phthalocyanine, thionocarbamate, thiophosphate or xanthogen formate functional group. Functional groups of these types can coordinate to various metals.

Advantageously, $R^1$ is $N^+R^{13}(Z^{m-})_{1/m}$. Quaternary ammonium polymeric precursors of this type can include the mineral binding moiety in a number of useful schemes.

In one scheme, the anion $Z^{m-}$ is the mineral binding moiety. For example, $Z^{m-}$ may be a dialkyl thiophosphate anion or a dialkoxy dithiophosphate anion, where the alkyl groups have between 1 and 6 carbon atoms, such as the diethyl thiophosphate anion. $Z^{m-}$ may instead be another mineral collector anion. Functional anions of this kind may be introduced to the cationic quaternary ammonium polymer either directly during synthesis or by ion exchange. Advantageously, the polymeric precursor may be an 'ionic liquid', which is either liquid at ambient temperature or of a low melting point. This enables processing of the polymeric precursor without the need for a solvent.

In another scheme, the polymer formed by polymerising the polymeric precursor encapsulates the mineral binding moiety. Polymers formed by polymerising polymeric precursors in which $R^1$ is $N^+R^{13}(Z^{m-})_{1/m}$ are particularly effective in encapsulating the mineral binding moiety. International publications WO2009/063211 and WO2007/012860, the entire contents of which are herein incorporated by reference, describe various encapsulation techniques using polymers of this type. A wide range of sizes, shapes and structures can be produced, including microspheres of diameters in the range 1-100 microns and particles, pellets, blocks and other structures of larger dimensions, from millimetres to metres. Also, it is possible to coat a variety of substrates with a thin film.

Where $Z^{m-}$ is not the mineral binding moiety, preferred anions are halide ions, preferably Br, tosylate, triflate, a borate ion, $PF_6^-$, or a carboxylic acid ester anion.

In preferred embodiments, the polymeric precursor is a monomer of formula (IV)

[IV]

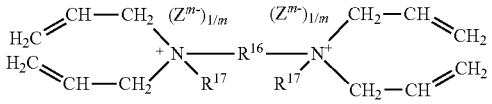

where $R^{16}$ is a straight or branched chain alkyl group, preferably having between one and twenty carbon atoms, most preferably having between two and twelve carbon atoms; and $R^{17}$ is hydrogen or a straight or branched chain alkyl group, preferably having between one and five carbon atoms, most preferably methyl or ethyl;

or a pre-polymer obtained by pre-polymerisation of said monomer.

In a preferred embodiment, the polymeric precursor is a monomer of formula (V)

[V]

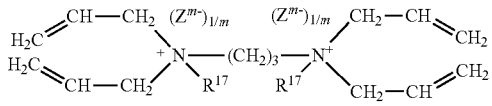

where preferably $R^{17}$ is methyl, or a pre-polymer obtained by pre-polymerisation of said monomer.

In another preferred embodiment, the polymeric precursor is a monomer of formula (VI)

[VI]

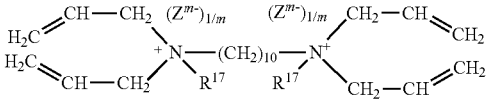

where preferably $R^{17}$ is methyl, or a pre-polymer obtained by pre-polymerisation of said monomer.

Alternatively, the polymeric precursor may be the diallyl equivalent of the tetraallyl monomers shown in formulae (IV)-(VI), such as a N,N-diallylbutane methyl quaternary ammonium compound with a suitable anion such as tosylate.

In other preferred embodiments, $R^{13}$ and $R^6$ together with the quaternarised N atom to which they are attached form a heterocyclic structure. Preferably, $R^3$ and $R^6$ together with the quaternarised N to which they are attached form an optionally substituted heterocyclic structure comprising a four to eight membered ring. The optionally substituted heterocyclic structure may be a five or a six membered ring. Most preferably, $R^{13}$ and $R^6$ together with the quaternarised N to which they are attached form an optionally substituted piperidine ring. U.S. Pat. No. 3,912,693, the entire contents of which are herein incorporated by reference, discloses processes for producing and polymerising monomers of the type in which $R^{13}$ and $R^6$ together with the quaternarised N atom to which they are attached form a heterocyclic structure. However, this publication does not even suggest that mineral processing of the type described herein might be contemplated.

The monomer may be a compound of formula (VII)

[VII]

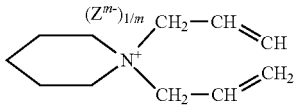

or a pre-polymer obtained by pre-polymerisation of said monomer may be used.

The heterocyclic structure may include at least one additional heteroatom in addition to the quaternarised N to which $R^{13}$ and $R^6$ are attached. The additional heteroatom may be N, O or S. Preferably, the heterocyclic structure includes at least two N heteroatoms, in which instance the monomer may be a compound of formula (VIII)

[VIII]

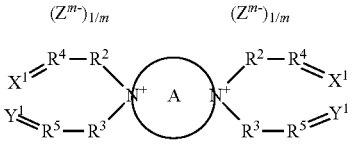

where A is a four to eight membered heterocyclic ring and the quaternarised nitrogens are present at any suitable pair of positions in the ring, or a pre-polymer obtained by pre-polymerisation of said monomer may be used. Preferably, A is a five or six membered heterocyclic ring. In embodiments in which A is a six membered heterocyclic ring, the ring may be a 1,2, a 1,3, or a 1,4 N substituted ring.

Advantageously, A is an optionally substituted piperazine ring. The monomer may be a compound of formula (IX)

[IX]

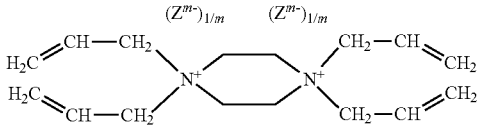

or a pre-polymer obtained by pre-polymerisation of said monomer may be used.

In embodiments in which the quaternarised N does not form part of a heterocyclic structure, $R^1$ may be H, an alkyl group, preferably having less than 3 carbon atoms, most preferably methyl, or $—R^{18}—R^{19}=Z^1$ where $R^{18}$ and $R^{19}$ are independently selected from $(CR^7R^8)_n$, or a group $CR^9R^{10}$, $CR^7R^8CR^9R^{10}$ or $CR^9R^{10}CR^7R^8$ where n is 0, 1 or 2, $R^7$ and $R^8$ are independently selected from hydrogen, halo or hydrocarbyl, and either one of $R^9$ or $R^{10}$ is hydrogen and the other is an electron withdrawing group, or $R^9$ and $R^{10}$ together form an electron withdrawing group, the dotted lines indicate the presence or absence of a bond, and $Z^1$ is a group $CZ^2—Z^3$ where the dotted line bond to which it is attached is absent and a group $CZ^2$ where the dotted line bond to which it is attached is present, and $Z^2$,$Z^3$ are independently selected from hydrogen, fluorine or other substituents.

In other preferred embodiments of polymeric precursors which include a group of sub-formula (I), $R^1$ is C(O)N or C(S)N. The mineral binding moiety may be incorporated within the 'core' structure of polymers of this type.

Advantageously the polymeric precursor is a compound of structure [X]

[X]

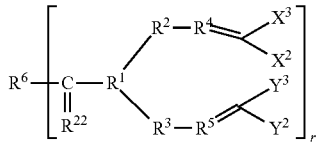

where $R^{22}$ is O or S, and $R^6$ includes the mineral binding moiety, or in conjunction with $C=R^{22}$ forms the mineral binding moiety.

The mineral binding moiety may be a thionocarbonate, thiourea thiol, thiocycloalkane, thiophosphate or xanthogen formate containing functional group.

The polymeric precursor may be a compound of structure [XT]

[XI]

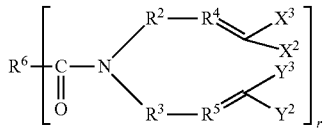

where $R^6$ contains the group —NHC(S)O, —C(O)NHC(S)O— or —O—C(S)SC(O)O—. Preferably, the polymeric precursor is a compound of structure [XII]

[XII]

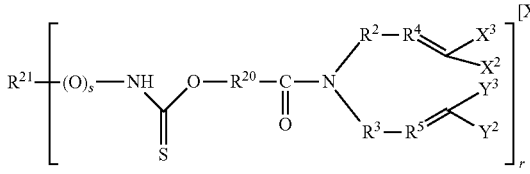

where $R^{20}$ and $R^{21}$ are each independently an alkyl group, optionally substituted or interposed with functional groups, preferably having one to twenty carbon atoms, most preferably having two to twelve carbon atoms, s is 0 or 1, and r is preferably 1 or 2, or a pre-polymer obtained by pre-polymerisation of said compound. Examples of compounds of structure [XII] include O-[4-(diallylamido) butyl]butylcarbamothioate (r=1, $R^{20}=CH_2CH_2CH_2$, $R^{2'}=CH_2CH_2CH_2CH_3$, and s=0) and O-[4-(diallylamido) butyl] acetylcarbamothioate (r=1, $R^{20}=CH_2CH_2CH_2$, $R^{21}=CH_3$, and s=1).

The polymeric precursor may be a compound of structure [XIII]

[XIII]

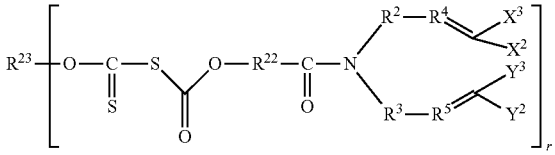

where $R^{22}$ and $R^{23}$ are each independently an alkyl group, optionally substituted or interposed with functional groups, preferably interposed with O, and preferably have one to twenty carbon atoms, most preferably two to twelve carbon atoms, and r is preferably 1 or 2, or a pre-polymer obtained by pre-polymerisation of said compound.

The polymeric precursor may be a compound of structure [XIV]

[XIV]

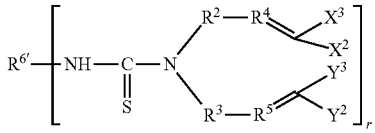

where $R^{6'}$—NH constitutes $R^6$, and $R^{6'}$ combination with —NH—CS forms the mineral binding moiety.

The polymeric precursor may be a compound of structure [XV]

[XV]

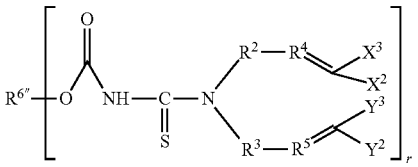

where $R^6$—OC(O)—NH constitutes $R^6$ and $R^{6''}$ in combination with —OC(O)—NH—CS forms the mineral binding moiety. The polymerisation of the polymeric precursor may produce a homopolymer. Alternatively, the step of polymerising the polymeric precursor may produce a copolymer, the polymeric precursor being mixed with one or more other polymeric precursor. The other polymeric precursor may be according to any of the formulae described herein. Alternatively, the co-monomer may be of a different class of compounds. The polymeric precursor may be copolymerised with a cross-linker. In these embodiments, the polymeric precursor may be reacted with a compound of formula (XVI)

[XVI]

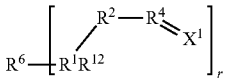

where $R^1$, $R^2$, $R^4$, $R^{12}$ and $X^1$ are as defined in relation to formula (I), r is an integer of 2 or more, and $R^6$ is a bridging group of valency r or a bond. Preferably, r is 2. The use of a compound of formula (XVI) is particularly advantageous when the polymeric precursor does not include the group —$R^3$—$R^5$=Y. However, embodiments of polymeric precursors which include the group —$R^3$—$R^5$=$Y^1$ may also be reacted with a compound of formula (XVI).

The compound of formula (XVI) may be a compound of formula (XVII)

[XVII]

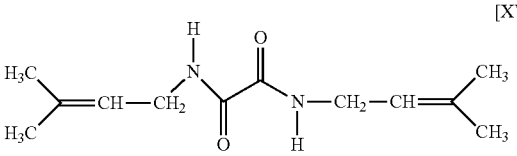

The monomer or co-monomers may be pre-polymerised to produce a pre-polymer. Typically, a thermal initiator is used and pre-polymerisation is performed at an elevated temperature above ambient temperature.

The polymeric material may be a methacrylate or a silane polymer. The methacrylate polymer may be formed from 2-hydroxy methacrylate which can be reacted with an thioisocyanate to produce a thiocarbamate. An amino functionalised silane could be used to produce a thiourea containing monomer. Alternatively, the mineral binding moiety may be encapsulated by the polymer.

The polymeric material may include an acrylate, polyurethane or styrene based polymer, The polymer may encapsulate the mineral binding moiety or the polymer may incorporate the mineral binding moiety within its polymeric structure.

In other embodiments, the polymeric material includes a polymeric substrate having a surface which has the mineral binding moiety attached thereto. The polymeric material may include polymeric chains which are grafted onto the surface of the polymeric substrate, wherein the polymeric chains include the mineral binding moiety. In principle, other forms of attachment, such as physisorption or ionic bonding, might be contemplated. The polymeric substrate may be an epoxide or a diisocynate having the polymeric chains grafted thereon. Polymeric substrates having surface hydroxyl or amine moieties may be used. Convenient reaction schemes include reactions of such polymeric substrates with amine or hydroxyl containing polymers to produce the polymeric chains, as understood by the skilled reader. However, many reaction schemes and candidate polymeric substrates and polymeric chains would suggest themselves to the skilled reader, who is directed to the extensive and well known reference literature which exists on the topic of polymer grafting.

The polymeric chains may include a polyimine, preferably polyethylene imine, which is functionalised by attachment of the mineral binding moiety. Alternatively, the polymeric chains may include a polymeric hydroxyl containing polymer such as polyvinyl alcohol (PVA) which is functionalised by attachment of the mineral binding moiety.

The mineral binding moiety may be a thionourea. This can be formed by the reaction of an isothiocyanate with an amine containing polymeric chain such as a polyimine. Alternatively, the mineral binding moiety may be a thiocarbamate. This can be formed by the reaction of an isothiocyanate with a hydroxyl containing polymeric chain such as a PVA. Other mineral binding moieties, such as those disclosed herein, may be attached to the polymeric chains using reaction schemes which are well known in the art.

In other embodiments, step b) includes the sub-steps of:

i) introducing a collector compound to the mixture of minerals, wherein the collector compound includes the mineral binding moiety and a polymer attachment moiety;

ii) selectively binding the collector compound to the metal containing mineral; and iii) attaching the collector compound to a polymer using the polymer attachment moiety.

In sub-step iii) the collector compound may be attached to the polymer by a covalent bond formed by a reaction between the polymer attachment moiety and a surface group of the polymer. In principle, other forms of attachment, such as physisorption or ionic bonding, might be contemplated. Where a covalent bond is formed, the reaction may be a $SN_2$ nucleophilic reaction. The covalent bond may be a C—N or C—O bond. In some embodiments, either the polymer attachment moiety is an amine functional group or hydroxyl, and the surface group is a leaving group, or the polymer attachment moiety is a leaving group and the surface group is an amine functional group or hydroxyl. Polymers having amine or hydroxyl surface groups are more easily reprocessed after use by, for example, abrasion. The polymer may be a cellulose or hydroxyl methacrylate polymer, optionally modified by converting surface hydroxyl groups to an improved leaving group such a tosyl ester. A 2-hydroxy methacrylate polymer may be used.

The mineral binding moiety may be an isothiocyanate moiety, such as an alkoxycarbonyl isothiocyanate moiety. Other possible mineral binding moieties are described elsewhere herein.

The polymeric material may be provided in a number of forms. Advantageously, a structure is provided which includes the polymeric material, the polymeric material being contacted by the mixture of minerals. This permits a straightforward separation of the metal containing mineral from the gangue minerals, for example by removing the polymeric material from the mixture of minerals, or vice versa. Any suitable structure might be employed, such as a membrane, optionally bonded onto a substrate. Alternatively, the structure may be porous, so that the mixture of minerals passes through the structure with the metal containing mineral being selectively bound by the mineral binding moiety and thereby separated from the gangue material which passes out of the structure. In these embodiments the structure may be a foam and/or a sheet material such as a mesh or filter. A mesh could be a weave or another porous network structure.

The structure may be formed from a substrate structure which is coated with the polymeric material.

Alternatively, the polymeric material may be present in particulate form. Typically, the use of particulate polymeric material results in a relatively large surface area being available for binding to the metal containing mineral. Separation of the gangue minerals can be easily achieved in a number of ways, such as by removal of the particulate polymeric material, or removal of the gangue minerals through a filter or by decanting.

Steps (a) to (c) may be performed as part of a flotation process for separating the gangue minerals from the metal containing mineral. In this way, the invention can be incorporated into conventional floatation processes. Particles of the polymeric material may be used which are designed to float, for example through the incorporation of air into the polymeric structure.

Typically, the mixture of minerals is present as a pulp including particulate minerals in water.

The method may include the further step of releasing the metal containing mineral from the polymeric material. Advantageously, this can be achieved easily with many polymers formed by polymerising a polymeric precursor of sub-formula (I) with the polymer being recovered for re-use. Release can be achieved through physical means such as agitation or ultrasound treatment, or by chemical means such as raising or lowering pH by addition of alkali or acid, or adding a chemical such as a depressant. The term 'depressant' is known in the prior art to describe a chemical which can be used to remove a collector chemical from a metal containing moiety. For example, sodium hydrosulphide is a depressant used to remove xanthates from copper suphides which may be used in connection with the present invention.

The method may include the further step of obtaining a quantity of the metal from the metal containing mineral. This may be achieved by a smelting process. It is preferred that the metal containing mineral is released from the polymeric material before the step of obtaining a quantity of the metal from the metal containing mineral. However, it is possible to perform the further step of obtaining a quantity of the metal from the metal containing mineral without previously releasing the metal containing mineral from the polymeric material.

It is advantageous that the invention can be performed on site at a mine.

According to a second aspect of the invention there is provided a metal containing mineral or metal obtained by a method according to the first aspect of the invention.

According to a third aspect of the invention there is provided the use of a polymeric material that includes a mineral binding moiety in the processing of a mixture of minerals to separate a metal containing mineral from gangue materials.

According to a fourth aspect of the invention there is provided a polymer obtained by the polymerisation of a polymeric precursor which includes a group of sub-formula [XVIII]

[XVIII]

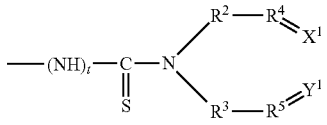

where t is 0 or 1, $R^2$ and $R^3$ are independently selected from $(CR^7R^8)_n$, or a group $CR^9R^{10}$, $CR^7R^8CR^9R^{10}$ or $CR^9R^{10}CR^7R^8$ where n is 0, 1 or 2, $R^7$ and $R^8$ are independently selected from hydrogen or alkyl, and either one of $R^9$ or $R^{10}$ is hydrogen and the other is an electron withdrawing group, or $R^9$ and $R^{10}$ together form an electron withdrawing group;

$R^4$ and $R^5$ are independently selected from CH or $CR^{11}$ where $CR^{11}$ is an electron withdrawing group, the dotted lines indicate the presence or absence of a bond, $X^1$ is a group $CX^2X^3$ where the dotted line bond to which it is attached is absent and a group $CX^2$ where the dotted line to which it is attached is present, $Y^1$ is a group $CY^2Y$ where the dotted line to which it is attached is absent and a group $CY^2$ where the dotted line to which it is attached is present, and $X^2X^3$, $Y^2$ and $Y^3$ are independently selected from hydrogen, fluorine or other substituents.

The polymeric precursor may be a compound of structure [XIX]

[XIX]

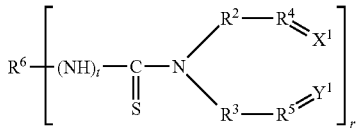

where r is an integer of 1 or more, $R^6$ is one or more of a bridging group, an optionally substituted hydrocarbyl group, a perhaloalkyl group, a siloxane group, an amide, or a partially polymerised chain containing repeat units.

The polymeric precursor may be a monomer of structure [XX]

[XX]

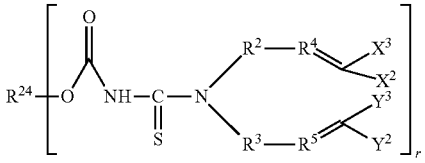

where $R^{24}$ is a hydrocarbyl group, optionally substituted or interposed with functional groups, or a pre-polymer obtained by pre-polymerisation of said monomer.

The polymeric precursor may be a monomer of structure [XXI]

[XXI]

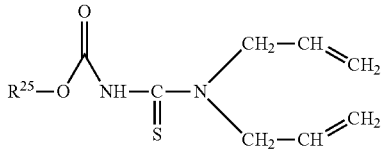

where $R^{25}$ is an alkyl group, optionally substituted or interposed with functional groups, preferably having one to twenty carbon options, most preferably having two to twelve carbon atoms, or a pre-polymer obtained by pre-polymerisation of said monomer.

Other polymeric precursors having a group of sub-formula [XVIII] can be obtained commercially, or synthesised from commercially available compounds using principles described in International Publications WO00/06610, WO00/06533, WO00/06658, WO01/36510, WO01/40874, WO01/74919 and WO2008/001102. These International Publications also provide further candidates for the $R^6$, $R^{24}$ and $R^{25}$ moieties described in Formulae [XIX]-[XXI].

According to a fifth aspect of the invention there is provided a method of processing a mixture of minerals including the steps of:

(a) providing a mixture of minerals which includes a metal containing mineral and one or more unwanted gangue materials;

(b) introducing a collector compound to the mixture of minerals, and wherein the collector compound includes a mineral binding moiety which selectively binds to the metal containing mineral, the collector compound further including a polymer attachment moiety;

(c) attaching the collector compound to a polymer using the polymer attachment moiety; and (d) separating the gangue minerals and the polymer which has the collector compound and the metal containing mineral bound thereto.

Whilst the invention has been described above, it extends to any inventive combination or sub-combination of the features set out above or in the following description or claims. The invention extends also to any inventive compounds, polymers and polymeric materials disclosed herein.

Example 1 Attraction of the Copper Sulphide, Chalcopyrite to a Tetraallyl Quaternary Ammonium Polymer Surface Containing the Collector Chemical o,o-Diethyl Thiophosphate Method The monomer N,N,N',N-tetraallylpropane-1,3-dimethylammonium p-toluene sulfonate (>99%, 0.965 g) was synthesised in accordance with the method described in Example 7 (synthetic details can also be found in the Applicant's earlier International Publication WO2009/063211), and dissolved in deionised water (0.080 g) using gentle heating and vigorous mixing. The photoinitiator 'Irgacure 2022' (Ciba SC) (0.0280 g) was then added, followed by the collector chemical potassium o,o-diethyl thiophosphate (Sigma Aldrich, 90%, 0.0285 g) which were thoroughly mixed into the liquid.

A small bead of this mixture was then placed onto a PTFE plate then cured using a FusionUV LH6 high intensity UV lamp with a D-bulb, 100% intensity at 2 m/minute belt speed using a single pass to produce a hard transparent solid.

A sample containing no collector chemical was also made using the same materials and in the same ratio used above but with the omission of o,o-diethyl thiophosphate. This was also cured as a bead of the same size using identical cure conditions.

Two vials each containing approximately 4 g of deionised water and 50 mg of chalcopyrite powder, ground from a larger piece of chalcopyrite crystal using a P100 grade abrasive paper to produce a dark grey powder, were prepared. A polymer bead containing the collector was placed into one vial and a polymer bead containing no collector was placed into the other vial and both vials were sealed and shaken, allowing the chalcopyrite powder to be suspended in the water and then settle evenly on the beads.

The samples were left for 4 hours, after which the beads were extracted and placed into separate beakers of water (200 ml) followed by gentle stirring of the water to remove any loose mineral grains on the surface. The beads were then extracted and placed onto a PTFE plate for examination.

Another reference sample bead containing no collector was also added to deionised water for 4 hours to test for any colour change of the polymer itself in water.

Results

The bead containing the collector chemical o,o-diethyl thiophosphate was darker in appearance than the reference sample without collector and much darker than a polymer bead containing collector that had not been placed into water and chalcopyrite.

The other reference sample bead of the same polymer containing no collector showed no change in appearance when added only to deionised water after 4 hours, suggesting the darkening in colour was attributable to the build up of chalcopyrite on the polymer surface.

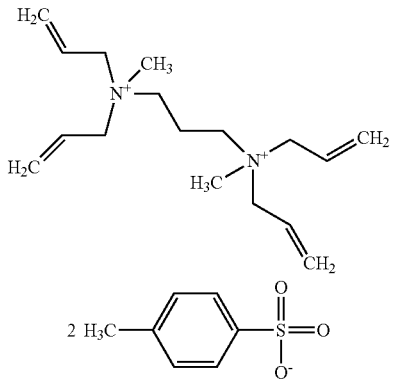

N,N,N',N'-tetraallylpropane-1,3-dimethylammonium p-toluene sulfonate

Example 2 Attraction of the Copper Sulphide, Chalcopyrite to a Tetraallyl Quaternary Ammonium Polymer Surface Containing the Collector Chemical o,o-Diethyl Thiophosphate after a Longer Duration of Exposure to Chalcopyrite Method Experiment 1 was repeated except that the polymer bead containing the collector and the reference sample without collector were placed in the chalcopyrite and deionised water mixture for 24 hours.

Results

The polymer bead containing the collector was even darker in appearance compared to the one that was left for 4 hours. The difference in appearance between the bead containing the collector and the reference bead no collector was even greater than that after 4 hours duration.

Example 3 Removal of Copper Mineral from a Tetraallyl Quaternary Ammonium Polymer Surface Using Ultrasonic Treatment Method The monomer N,N,N',N'-tetraallylpropane-1,3-dimethylammonium p-toluene sulfonate (>99%, 1.47 g) was dissolved in deonised water (0.28 g) using gentle heating. The collector chemical potassium o,o-diethyl thiophosphate (Sigma Aldrich, 90%, 0.13 g) was dissolved into the mixture, followed by the addition of the photoinitiator 'Irgacure 2022' (Ciba SC) (approx. 40 mg) with thorough mixing.

Part of the mixture was then placed between two glass slides and cured using a FusionUV LH6 high intensity UV lamp with a D-bulb, 100% intensity at 4 m/minute belt speed with two passes to produce a transparent solid.

A polymer film was then recovered from the microscope slides, which was then placed into a mixture containing approximately 200 mg of each of the following powders: Cu(I) sulphide (−325 mesh), Cu(II)sulphide (−100 mesh), Cu(I)oxide (<5 microns) and Cu metal powders (10-425 microns) in deionsed water (100 ml). The resulting mixture was shaken gently to disperse the minerals, enabling a uniform layer to remain over the polymer film.

After 2 hours the film was removed from the mixture and placed into a beaker of deionised water (200 ml) and gently shaken to remove any loose mineral on the surface. The film was then removed and placed into a beaker containing approximately 100 ml of water and then treated in an ultrasonic bath for a duration of 3 seconds.

Results

Almost all of the copper mineral was seen to instantly detach from the film after the ultrasonic treatment was started.

Example 4 Synthesis of O-[4-(diallylamido)-butyl] butylcarbamothioate (a Diallylamide Monomer Containing an Alkyl Thionocarbamate Group)

Preparation of the amido alcohol intermediate, N,N-diallyl-4-hydroxy-butanamide

Gamma butyrolactone (171.0 g, 1.99 mol) and diallylamine (490.0 g, 5.04 mol) were mixed together and heated to 120° C. The mixture was stirred at this temperature for 33 h. A portion (200 g) was stripped, ramping to 110° C. in vacuo (30 mBar), this removed diallylamine but not the gamma butyrolactone.

FTIR (Thin Film): 3420, 3082, 1773, 1630, 1196, 993, 927 $cm^{-1}$.

From the material stripped at 110° C. in vacuo 70 g was taken up in ethyl acetate (200 ml), dried ($MgSO_4$), then passed through a plug of silica, flushing through with further ethyl acetate (2×200 ml). The solvent was removed in vacuo.

The amido alcohol, containing trace gamma butyrolactone (13.2 g, ~0.06 mol) was mixed with water tap water (260 ml) in a flask. To this mixture was added sodium hydroxide (1.4 g, 0.035 mol). The mixture was heated to 70° C. for 16 h. The temperature was increased to reflux and held at this temperature for 2 h. The reaction was allowed to cool to room temperature. Dichloromethane (100 ml) was charged to the flask. The layers were separated. The aqueous was extracted with a dichloromethane (100 ml). The layers were separated and the organics were combined, dried ($MgSO_4$) and concentrated in vacuo. This gave 6.0 g (45% recovery).

FTIR (Thin Film): 3419, 3083, 1629, 1196, 993, 926 $cm^{-1}$.

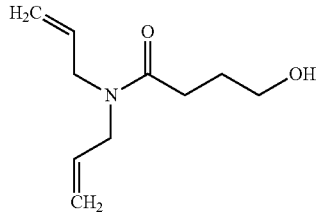

N,N-diallyl-4-hydroxy-butanamide

Synthesis of O-[4-(diallylamido)-buty]butylcarbamothioate

N,N-diallyl-4-hydroxy-butanamide, containing gamma-butyrolactone (15.0 g, ~0.07 mol) was charged to a flame dried flask. Butyl isothiocyanate (14.7 g, 0.08 mol) was added dropwise from via a dropping funnel. The mixture was warmed to 60° C. and left stirring at this temperature for 18 h. The mixture was allowed to cool to room temperature. Dibutyl tin dilaurate (0.25 g, 0.4 mmol) was added dropwise. The mixture was heated to 60° C. and left stirring for 64 h. After this time the reaction temperature was increased to 101° C. for 42 h. The mixture was allowed to cool to room temperature. Residual butyl isothiocyanate was stripped from the reaction in vacuo. This gave a brown oil (21.9 g, 92% crude yield).

FTIR (Thin Film): 3326, 3082, 1774 1716, 16, 1546, 1196, 993, 925 $cm^{-1}$.

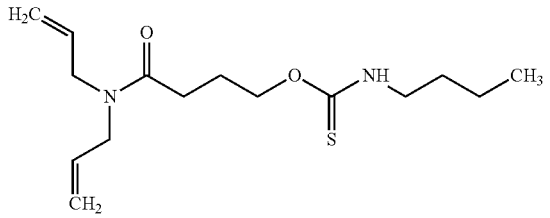

Example 5 Synthesis of O-[4-(diallylamido)butyl] acetylcarbamothioate (a diallylamide monomer containing aalkylcarbonyl thionocarbamate group)

N,N-diallyl-4-hydroxy-butanamide (5.8 g, 0.03 mol) was charged to a flame dried flask. Acetyl isothiocyanate (3.2 g, 0.03 mol) was added dropwise, under nitrogen. With the aid of a water bath the reaction temperature was maintained below 30° C. The reaction was heated to 30° C. and stirred at this temperature for 18 h. A further portion of N,N-diallyl-4-hydroxy-butanamide (0.5 g, 0.02 mol) was charged and the mixture was stirred for 5 h. The reaction mixture was then heated in vacuo (91° C./30 mBar) over 2.5 h.

A portion of the reaction mixture was removed (2.8 g, 0.01 mol) was dissolved in tetrahydrofuran (25 ml). To this solution was charged sodium hydroxide (0.11 g, 0.003 mol) and warm tap water (25 ml). The mixture was left to stir at ambient temperature overnight. To this mixture was charged dichloromethane (100 ml). The layers were separated and the aqueous layer was further extracted with dichloromethane (2×50 ml). The combined organics were dried ($MgSO_4$) taken up in ethyl acetate (50 ml) and passed through a plug of silica. The ethyl acetate was removed in vacuo and the oil was purified by silica flash column chromatography (eluant: 40-60° C. petrol/ethyl acetate 3:1). This gave a yellow oil (0.48 g, 17% recovery, 5.6% overall) that was 95% pure by 1H NMR analysis.

FTIR (Film): 3459, 3082, 1738, 1651, 1546, 1196, 994, 928 $cm^{-1}$.

$^1H$ NMR ($CDCl_3$): 1.7 (br, 0.6H), 1.95 (m, 1.9H), 2.05 (s, 2.9H), 2.3 (s, 0.8H), 2.4 (t, 1.9H), 3.85 (d, 2.1H), 3.95 (d, 2.1H), 4.1 (t, 2.0H), 5.15 (n, 4.2H), 5.7 (m, 2.0H) ppm.

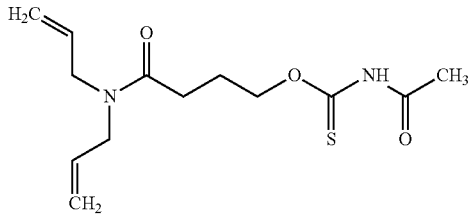

O-[4-(diallylamido)butyl]acetylcarbamothioate

Example 6 Collection of chalcopyrite powder ($CuFeS_2$) onto a polymer Film Consisting of a Copolymer Poly(N,N,N',N'-Tetraallylethnediamide-Co-O-[4-(diallylamido)butyl] acetylcarbamothioate)

A mixture of the difunctional monomer N,N,N',N'-tetraallylethanediamide and the monofunctional monomer O-[4-(diallylamido)butyl]acetylcarbamothioate) was made in the ratio of 3:1 w/w respectively. The photointiator Irgacure 2022 (Ciba SC) (3 wt %) was then added and mixed thoroughly with gentle warming. This mixture was then deposited as thin film onto a uPVC substrate and then polymerised to a solid copolymer using a high intensity UV lamp (Fe doped mercury bulb, 200 W/cm, 2 passes at 2 metres/minute).

A reference sample was also made containing no thionocarbamate groups in the polymer a mixture of the monomers N,N,N',N'-tetraallylethanediamide and N,N-diallylhexanamide was made in the ratio of 3:1 w/w respectively. N,N-diallylhexanamide was synthesised in accordance with Example 10. The photointiator rgacure 2022 (Ciba SC) (3 wt %) was then added and mixed thoroughly with gentle warming. This was cured identically to the mixture above containing the thionocarbamate functionalised monomer.

Both samples were cleaned in deionised water and then placed into separate slurries each containing 50 mg of chaicopyrite, ground from a large crystal using a P100 abrasive paper, and 50 ml of deionised water for 18 hours.

Results

Each polymer sample was removed from the slurry. The polymer sample containing O-[4-(diallylamido)butyl] acetylcarbamothioate had attracted more chalcopyrite than the reference sample, demonstrated by its darker appearance, which was then washed off under a stream of water to yield free chalcopyrite powder.

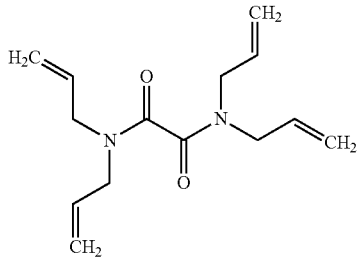

N, N, N', N'-Tetraallylethanediarmide

Synthesis of N, N, N', N-Tetraallylethanediamide

Fresh, dry oxaloyl chloride (ClOOCCOOCl) (200 mmoles) was placed into a 3-necked round bottomed (RB) flask with 200 ml of dry dichloromethane. Freshly distilled diallylamine (400 mmoles) was added to triethylamine (400 mmoles), further diluted (1:1 v/v) in dry dichloromethane then added into a dropping funnel and placed onto the reaction flask. Nitrogen gas was pumped through the vessel through the other two necks. To neutralise HCl produced, the waste gas was bubbled through a $CaCO_3$ solution. The reaction vessel was then placed into a salt water/ice bath and once the contents were cooled the diallylamine/triethylamine/DCM was added dropwise to the acid chloride solution with continual magnetic stirring of the mixture. The temperature was monitored and maintained between 5-10° C. The dropping of the diallylamine and triethylamine was stopped after three hours and the reaction was left to stir for another hour.

Thin layer chromatography using ethyl acetate and an alumina was used to monitor the reaction comparing starting material to the product. Iodine was used to develop the plate and the reaction product could be seen as a spot that had been eluted much further than the starting material.

To remove the amine chloride and excess diallylamine the reaction liquor was washed in 3M HCl. The monomer stayed in the DCM fraction and was removed using a separating funnel. Two washes of 100 ml HCl were used. The solvent was then removed in a rotary evaporator.

The product was added to dichloromethane (1:1 v/v) and passed through a silica gel (Merck, grade 60 for chromatography) column with dichloromethane as the eluent.

Example 7 Synthesis of N,N,N',N'-tetraallyl propane dimethylammonium Dithiosphosphate (a Quaternary Ammonium Monomer Containing a Collector Group as an Anion)

Synthesis of Diamine Intermediate A:

1,3-dibromopropane (99%, 150.0 g, 0.7429 moles), potassium carbonate (97%, 456 g, 3.2996 moles) and 2-propanol (400 ml) were added to an RB reaction flask and brought to reflux with stirring. Diallylamine (99%, 160.5 g, 1.6519 moles), was added to the reaction mixture gradually over an hour and reflux maintained for 120 hours before cooling to room temperature. The mixture was then filtered and the volatiles removed under vacuum. A yellow oil was produced, which was further purified by column chromatography using silica (60 Å) and DCM as eluent. After removal of the DCM a pale yellow oil was produced (density=0.86 g/cm, yield=80%).

Synthesis of N,N,N',N-tetraallyl propane dimethaminium dithiosphosphate

The diamine intermediate A (6.4 g) was added to anhydrous 2-propanol (200 ml) and stirred at room temperature followed by the addition of o,o-dithiophosphate (9.213 g) over 30 minutes to produce a quaternary ammonium salt (pH=6.5). The 2-propanol was then removed in vacuum to produce the quaternary diallyl ammonium monomer. Yield ~95%.

The monomer can be polymerised using the principles described in Example 1.

Example 8 Collection of a Chalcopyrite Rich Mineral Using a Copolymer Consisting of poly(N,N-diallyl ethoxycarbonyl thionourea-co-N,N,N',N'-tetraallylethanediamide)

Synthesis of N,N-diallyl ethoxycarbonyl thionourea (ethyl[di(allyl)carbamothioyl]carbamate)

Ethoxycarbonyl isothiocyanate (98%, 5.00 g) was added dropwise to a mixture of freshly distilled diallylamine (4.0 g) and dichloromethane (50 ml) with continuous stirring for approximately 30 minutes. An exotherm was seen on addition of the isothiocyanate and the temperature was allowed to rise from room temperature to reflux temperature (40° C.). The mixture was left to react for a further 90 minutes after which the mixture was added to ethyl acetate (150 ml) and passed through a short path silica column (6 cm depth) under a partial vacuum. The solution was then filtered and processed in a rotary evaporator to remove any volatiles. Yield=89%

$^1$H NMR (500 MHz, $CDCl_3$) δ/ppm=1.3 (t), 4.2 (q), 4.5 (m), 5.2 (d), 5.85 (m), 7.3 (s)

N,N,N',N'-tetraallyl ethanediamide was synthesised in accordance with Example 6.

N,N-diallyl ethoxycarbonyl thionourea and N,N,N',N'-tetraallyl ethanediamide crosslinker were added together as a 1:1 (w/w) mixture with the photoinitiator Irgacure 2022 added as 3.5% by weight to the total monomer mixture. This was mixed thoroughly and coated onto a flat piece of poly(carbonate) measuring ~10 cm×15 cm using a sponge roller until an even coating was made at a weight of approximately 3 gsm. The sample was passed under a focused high intensity UV lamp (FusionUV LH6, D bulb, 100% intensity with 5 passes at 3.5 m/minute).

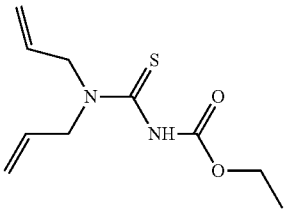

N,N-diallyl ethoxycarbonyl thionourea

The coated panel was placed in a horizontal testing jig that could expose the sample to a slurry over an area of ~112 $cm^2$, 2.0 cm depth. A body of mineral containing chalcopyrite as the major component (42% w/w) with the remainder a mixture of mostly iron sulphides (Pyrrhotite 20% w/w), (Pyrite 16% w/w), was ground in a ball mill to a size fraction of less than 106 m (particle size distribution D10[5.68 μm] D50[37.29 μm], D90[106.9 μm]). 2.0 g of this mineral powder was added to 200 ml of deionised water to make a slurry that was thoroughly dispersed before adding to the test jig that contained the sample panel. The test jig was left stationary for 20 minutes after which the excess mineral was poured away and the mineral adhered to the polymer surface collected using filtration from a mineral concentrate. The mineral collected was thoroughly dried and weighed. This test was repeated several times, with an average taken of the weight collected per unit area of polymer surface compared to a reference polymer that did not contain a thionourea group (see reference sample)

The sample containing the thionourea collector group gave an increase of 32% in weight of mineral collected compared to a reference polymer (Example 10) made with N,N-diallylhexanarmide replacing N,N-diallylthionourea.

Example 9 Collection of a chalcopyrite rich mineral using a copolymer consisting of poly(2-{2-[2-(2-ethylethoxy xanthogen formate)ethoxy)ethoxy) ethyl-N,N-diallylcarbamate-co-N,N,N',N'-tetraallyl ethanediamide)

Synthesis of a monomer 2-{2-[2-(2-ethylethoxy xanthogen formate)ethoxy)ethoxy)ethyl-N,N-diallyl-carbamate Triethyleneglycol bischloroformate (97%, Alfa-Aesar, 275.08 g), dry tetrahydrofuran (43.5 g) and triethylamine (101.2 g) were mixed with continuous stirring at 25° C. Diallylamine (97.16 g) was added dropwise to the stirred mixture over 30 minutes so that the exotherm did not rise above 30° C. with the reaction was left to proceed for a further hour. Potassium ethyl xanthogen formate (96%, Aldrich, 160.3 g) was then charged into the reaction mixture over 15 minutes and maintained at 25° C. for 1 hour with continuous stirring. The temperature was raised to 50° C. and maintained for another hour. After cooling, the mixture was filtered then washed with 2×100 ml of water. Residual water was removed with anhydrous $MgSO_4$ before re-filtering after which the sample was further purified by removal of crystalline residues. Solvent was then removed using a rotary evaporator.

$^1$H NMR ($CDCl_3$) δ/ppm=1.1 (t), 1.3 (weak, t), 1.4 (weak, m), 3.3 (m), 3.55 (m), 3.65 (m), 3.75 (m), 4.2 (weak, m), 4.3 (s), 4.7 (s), 5.2 (m), 5.8 (m)

N,N,N',N'-tetraallyl ethanediamide was synthesised in accordance with Example 6.

The xanthogen formate containing monomer (2-{2-[2-(2-ethylethoxy xanthogen formate)ethoxy)ethoxy)ethyl-N,N-diallylarbamate and the crosslinker N,N,N',N'-tetraallyl ethanediamide were added together as a 1:1 (w/w) mixture with the photoinitiator rgacure 2022 added as 3.5% by weight to the total monomer mixture. This was mixed thoroughly and coated onto a flat piece of poly(carbonate) measuring 10 cm×15 cm using a sponge roller until an even coating was made at a weight of approximately 3 gsm. The sample was passed under a focused high intensity UV lamp (FusionUV LH6, D bulb, 100% intensity with 5 passes at 3.5 m/minute).

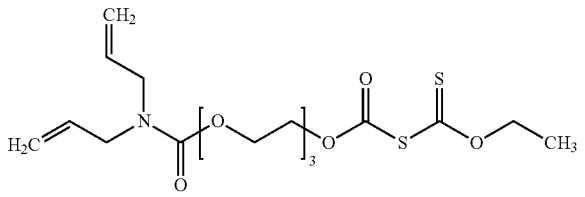

2-{2-[2-(2-ethylethoxy xanthogen formate)ethoxy) ethoxy)ethyl-N,N-diallylcarbamate The coated panel was placed in a horizontal testing jig that could expose the sample to a slurry over an area of ~112 cm, 2.0 cm depth. A body of mineral containing chalcopyrite as the major component (42% w/w) with the remainder a mixture of mostly iron sulphides (Pyrrhotite 20% w/w), (Pyrite 16% w/w), was ground in a ball mill to a size fraction of less than 106 m (particle size distribution D10[5.68 n] D50[37.29 μm], D90[106.9 μm]). 2.0 g of this mineral powder was added to 200 ml of deionised water to make a slurry that was thoroughly dispersed before adding to the test jig that contained the sample panel. The test jig was left stationary for 20 minutes after which the excess mineral was poured away and the mineral adhered to the polymer surface collected using filtration from a mineral concentrate. The mineral collected was thoroughly dried and weighed. This test was repeated several times, with an average taken of the weight collected per unit area of polymer surface compared to a reference polymer that replaced the xanthogen formate group with an alkyl group.

The sample containing the xanthogen formate collector group gave an increase of 139% in weight of mineral collected compared to a reference polymer made with N,N-diallylhexanamide (Example 10) instead of the xanthogen formate modified monomer.

Example 10 Collection of a Chalcopyrite Rich Mineral Using a Copolymer Consisting of poly(N,N-diallyl hexanamide-co-N,N,N',N'-tetraallyl ethanediamide) as a reference N,N-diallyl hexanamide and N,N,N',N'-tetraallyl ethanediamide crosslinker were added together as a 1:1 (w/w) mixture with the photoinitiator Irgacure 2022 added as 3.5% by weight to the total monomer mixture. This was mixed thoroughly and coated onto a flat piece of poly(carbonate) measuring ~10 cm×15 cm using a sponge roller until an even coating was made at a weight of approximately 3 gsm. The sample was passed under a focused high intensity UV lamp (FusionUV LH6, D bulb, 100% intensity with 4 passes at 3.5 m/minute).

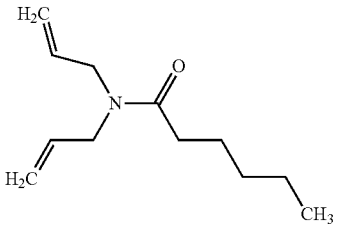

The coated panel was placed in a horizontal testing jig that could expose the sample to a slurry over an area of ~112 $cm^2$, 2.0 cm depth. A body of mineral containing chalcopyrite as the major component (42% w/w) with the remainder a mixture of mostly iron sulphides (Pyrrhotite 20% w/w), (Pyrite 16% w/w), was ground in a ball mill to a size fraction of less than 106 m (particle size distribution D10[5.68 n] D50[37.29 μm], D90[106.9 μm]). 2.0 g of this mineral powder was added to 200 ml of deionsed water to make a slurry that was thoroughly dispersed before adding to the test jig that contained the sample panel. The test jig was left stationary for 20 minutes after which the excess mineral was poured away and the mineral adhered to the polymer surface collected using filtration from a mineral concentrate. The mineral collected was thoroughly dried and weighed. This test was repeated several times, with an average taken of the weight collected per unit area of polymer surface (20.4 $g/m^2$).

Synthesis of N,N-diallylhexanamide

Diallylamine (99%, 37.0 g), triethylamine (99%, 40.0 g) and dichloromethane (99+%, 50 ml) were mixed and added dropwise to a cooled (0° C.) mixture of hexanoyl chloride (99%+, 50.0 g) in dichloromethane (99+%, 200 ml). Temperature was maintained between 0-10° C. with continuous stirring for several hours to allow all of the diallylamine mixture to be added. The reaction mixture was then left to come to room temperature.

The reaction mixture was then washed in dilute HCl (3M, 500 ml) and the organic layer separated. Washing of the organic layer was repeated in water or weak brine, followed by drying of the organic layer with anhydrous magnesium sulphate. Dichloromethane and other volatiles were then removed under vacuum to produce a pale yellow liquid, which was then purified further by column chromatography using silica gel (60 Å) and dichloromethane as eluent to yield an almost colourless oil. Yield ~70%.

$^1$H NMR ($CDCl_3$) δ/ppm: 0.85 (t), 1.25 (m), 1.6 (m), 2.25 (t), 3.8 (d), 3.9 (d), 5.1 (m), 5.7 (m)

Example 11 Collection of a chalcopyrite rich mineral using a copolymer consisting of poly(N, N, N', N'-tetraallylpropane-1,3-dimethylammonium tosylate-co-N,N-diallylbutane methyl ammonium tosylate) and the collector o,o-diethyl thiophosphate (potassium o,o-diethyl thiophosphate) Encapsulated within the Polymer Synthesis of N,N-diallylbutane methylammonium tosylate (i) Preparation of N,N-diallylbutan-1-amine intermediate Diallylamine (563.9 g, 5.8 mol) and deionised water (875 ml) were charged to a round bottomed flask equipped with thermometer, condenser and magnetic stirrer bar. Gradually n-butylbromide (194.3 g, 1.4 mol) was added dropwise. The reaction mixture was heated to 60° C. and held at this temperature for 24 h. The reaction was cooled to 40° C. and potassium hydroxide (188 g, 50 wt % solution, 3.3 mol) was charged slowly. Stirring was stopped and the reaction was allowed to settle into layers. The top layer was removed. The lower layer was extracted with dicholoromethane (DCM, 3×400 ml). The combined DCM extracts were stripped as a fraction with a second fraction of crude product. The crude product with distilled ($T_{oil}$=50° C. to 87° C., ~30 mBar) to give a clear oil (165.6 g, 76%).

FTIR (Film): 3078, 1643, 995, 917 $cm^{-1}$.

$^1H$ NMR ($CDCl_3$): δ 0.85 (m, 1.1H, imp), 0.95 (t, 3.2H), 1.25 (m, 2.8H), 1.45 (m, 2.2H), 1.65 (br, 2.2H), 2.4 (m, 2H), 3.1 (d, 4H), 3.25 (m, 0.3H, imp), 5.1 (m, 4.2H), 6.85 (n, 2.1H).

(ii) Preparation of Product

N,N-Diallylbutan-1-amine (162.7 g, 1.06 mol) and toluene (732 ml) were charged to a reactor equipped with mechanical stirrer, thermometer, condenser and nitrogen inlet. The mixture was heated to reflux. Methyl-para-toluene sulfonate (186 g, 1 mol) was gradually charged to the reactor over 1 h 20 minutes. After a further 2 h refluxing the mixture was cooled to ambient temperature. The reaction mixture was charged to a separating funnel and the crude product layer was run off. The crude product is gradually stripped in vacuo (~30 mBar), gradually increasing the oil bath temperature to 150° C. The crude product is held under these conditions for 3.5 h then cooled to ambient under a nitrogen purge. A viscous golden brown oil is obtained (293 g, 86%).

FTIR (Film): 3700-3100 (br), 3088, 3029, 2964, 2875, 1644, 1478, 1215, 1191, 1122, 1035, 1012, 683 $cm^{-1}$.

$^1H$ NMR ($CDCl_3$): δ 0.85 (t, 2.7H), 1.25 (m, 1.8H), 1.65 (m, 1.8H), 2.3 (s, 3.1H), 2.45 (br, 0.9H), 2.9 (m, 0.2H, imp), 3.1 (2s, 3H), 3.2 (m, 1.6H), 3.65 (m, 0.4H, imp), 4.0 (m, 3.3H), 4.05 (m, 0.3H), 5.45 (m, 0.4H), 5.6 (2d, 3.6H), 5.85 (i, 1.7H), 6.0 (m, 0.3H), 7.1 (t, 2H), 7.75 (t, 2H), 10.15 (m, 0.07H, imp).

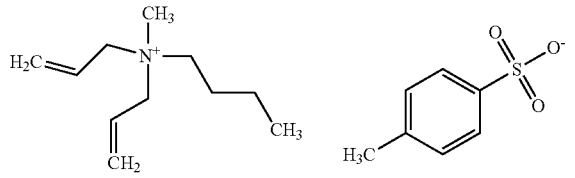

N,N-diallylbutane methylammonium tosylate

The monomer N,N,N',N'-tetraallylpropane-1,3-dimethylammonium tosylate was synthesised in accordance with the method described in Example 7. Synthetic details can also be found in the Applicant's earlier International Publication WO2009/063211.

A mixture containing the monomers N, N, N', N'-tetraallylpropane-1,3-dimethylammonium tosylate (14.037 g) and N,N-diallylbutane methyl ammonium tosylate (21.070 g) with potassium o,o-diethyl thiophosphate (0.848 g), deionised water (0.889 g) was heated to 80° C. for several hours with ultrasonic treatment to help dissolve potassium o,o-diethyl thiophosphate. The sample was cooled and the photo-initiator Irgacure 2022 added (0.732 g) with the sample again heated and mixed in similar way to produce a viscous liquid that was applied onto a polycarbonate panel (10 cm×15 cm, 2 mm thick) as uniform layer 1-2 mm thick over an 8 cm×8 cm area. This was cured by passing under a high intensity UV lamp 3 times at 2.0 n/minute (Fusion UV LH6, D bulb, 100% power) to produce a solid film.

The coated panel was placed in a horizontal testing jig, that could contain a slurry in a volume of dimensions 8 cm×8 cm area, 1.0 cm depth. A body of mineral containing chalcopyrite as the major component (42% w/w) with the remainder a mixture of mostly iron sulphides (Pyrrhotite 20% w/w), (Pyrite 16% w/w), was ground in a ball mill to a size fraction of less than 106 μm (particle size distribution D10[5.68 μm] D50[37.29 μm], D90[106.9 μm]). 0.3 g of this mineral powder was added to 30 ml of deionised water to make a slurry that was thoroughly dispersed before adding to the test jig that contained the sample panel. The test jig was left stationary for 20 minutes after which the excess mineral was poured away and the mineral adhered to the polymer surface collected using filtration from a mineral concentrate. The mineral collected was thoroughly dried and weighed. This test was repeated several times, with an average taken of the weight collected per unit area of polymer surface compared to a reference polymer that did not contain any potassium o,o-diethyl thiophosphate Reference Polymer A sample was made identically to the above sample panel, apart from no potassium o,o-diethyl thiophosphate being added. This panel was also tested identically to samples with the potassium o,o-diethyl thiophosphate.

The sample containing the collector material potassium o,o-diethyl thiophosphate collector gave an increase of 24% in weight of mineral collected compared to the reference polymer.

Example 12 Collection of Chalcopyrite Rich Mineral Using a Copolymer Consisting of poly(N, N, N', N'-Tetraallylpropane-1,3-dimethylammonium tosylate-co-N,N-diallylbutane methyl ammonium tosylate-co-1,1-diallyl piperidinium O,O-diethyl thiophosphate)

Synthesis of 1,1-diallyl piperidinium O,O-diethyl thiophosphate

(i) Synthesis of N,N-diallylpiperidine bromide Intermediate

A mixture of potassium carbonate (103.66 g), isopropanol (78.50 g) and allyl bromide (133.08 g) were charged into a flask and left stirring at room temperature. Piperidine (42.58 g) was added dropwise over 1 hour with constant stirring with an instant exotherm observed. Temperature was maintained below 50° C. with occasional rises to 60° C. seen straight after addition of piperidine. The reaction was then brought to reflux and held for 24 hours with constant stirring. The mixture was then left to cool to approximately 50° C. for work up. The warm reaction mixture was filtered to remove potassium carbonate and precipitated salts formed during the reaction. The solids were washed in dichloromethane to remove residual product and added to the filtered reaction product. Rotary evaporation was used to remove solvent and volatiles until a soft, amber coloured solid remained. Toluene was then added (300 ml) to wash the product, which was then filtered under vacuum followed by rewashing with toluene until the toluene liquid fraction was clear. Washing with acetone was performed to yield an off-white powder that was then dried at 60° C.

Yield 60.4%

$^1H$ NMR ($CDCl_3$) δ: 1.8 (m), 1.9 (m), 3.7 (m), 4.25 (m), 5.75 (m), 5.95 (m)

(ii) Preparation of Product

O,O-Diethyl thiophosphate potassium salt (10.0 g, 0.048 mol) and methanol (150 ml) were charged to a flame dried flask. In a separate flame dried flask 1,1-diallylpiperidinium bromide (11.8 g, 0.048 mol) was dissolved in methanol (30 ml), this solution was charged to the first flask, washing in with methanol (20 ml). The reaction mixture was heated to reflux and held at this temperature for 24 h and then cooled to room temperature. The solvent was removed in vacua. The residual slurry was dissolved in chloroform (60 ml) and solids were removed by decanting the chloroform solution. Further chloroform was added (20 ml). The chloroform solution was washed with deionised water (5 ml). The layers were separated and the chloroform layer was washed with further deionised water (5 ml). The chloroform was removed in vacuo to give a clear yellow oil (14.4 g, 89%).

FTIR (Film): 3406, 3085, 1642, 1469, 1165, 1042, 937 $cm^{-1}$.

$^1H$ NMR ($CDCl_3$) δ: 1.2 (t, 5.8H), 1.75 (m, 2H), 2.7 (br, 1.7H, imp), 3.6 (t, 4H), 3.95 (m, 3.8H), 4.1 (t, 4.0H), 5.65 (d, 2H), 5.75 (d, 2.0H) 5.95 (m, 2H) ppm.

The syntheses of N, N, N', N'-Tetraallylpropane-1,3-dimethylammonium tosylate and N,N-diallylbutane methyl ammonium tosylate are described in Example 11.

N, N, N', N'-Tetraallylpropane-1,3-dimethylammonium tosylate (5.00 g) was heated until molten and mixed with N,N-diallylbutane methyl ammonium tosylate (2.50 g) and reheated to 80° C. with periodic mixing in an ultrasonic bath. 1,1-diallyl piperidinium O,O-diethyl thiophosphate (2.50 g) was then added to the mixture, which was maintained at 800 for one hour until fully dissolved and dispersed with periodic treatment in an ultrasonic bath. Irgacure 2022 was then added at 2% by weight of total monomers to produce a viscous liquid that was applied onto a polycarbonate panel (10 cm×15 cm, 2 mm thick) as uniform layer 1-2 mm thick over an 8 cm×8 cm area. This was cured by passing under a high intensity UV lamp 2 times at 3.0 m/minute (Fusion UV LH6, D bulb, 100% power) to produce a solid film.

The coated panel was placed in a horizontal testing jig, that could contain a slurry in a volume of dimensions 8 cm×8 cm area, 1.0 cm depth. A body of mineral containing chalcopyrite as the major component (42% w/w) with the remainder a mixture of other minerals that included mainly iron suphides (Pyrrhotite 20% w/w), (Pyrite 16% w/w), was ground in a ball mill to a size fraction of less than 106 μm. (Distribution D10[5.68 μm] D50[37.29 μm], D90[106.9 μm])). 0.3 g of this mineral powder was added to 30 ml of deionised water to make a slurry that was thoroughly dispersed before adding to the test jig that contained the sample panel. The test jig was left still for 20 minutes after which the excess mineral was poured away and the mineral adhered to the polymer surface collected using filtration from a concentrate of the collected mineral in water. The mineral collected was thoroughly dried and weighed. This test was repeated several times, with an average taken of the weight collected per unit area of polymer surface compared to a reference polymer that did not contain any o,o-diethyl thiophosphate.

Reference Panel

A sample was made in an identical way to the polymer containing the thiophosphate unit but with all of the 1,1-diallyl piperidinium O,O-diethyl thiophosphate replaced with N,N-diallylbutane methylammonium tosylate to make a poly(N, N, N', N'-Tetraallylpropane-1,3-dimethylammonium tosylate-co-N,N-diallylbutane methyl ammonium tosylate) copolymer. This panel was also tested identically to samples with the o,o-diethyl thiophoshphate.

The sample containing the collector material o,o-diethyl thiophosphate collector gave an increase of 14% increase in weight of mineral collected compared to the reference polymer.

Example 13 Collection of a Chalcopyrite Rich Mineral Using a Polymer Surface Consisting of Functionalised Poly(Ethyleneimine) Grafted onto a Poly(Lycidyl Methacrylate-Co-Ethyleneglycol Dimethacrylate) Surface A nylon 6,6 panel (dimensions 10 cm×15 cm) was coated with a thin layer a 2-3 microns thick of a mixture consisting of glycidyl methacrylate (97%, Aldrich, 0.81 g), ethyleneglycol dimethacrylate crosslinker (98%, Alfa Aesar, 0.20 g) and the photoinitiator Irgacure 2022 (0.025 g). This was cured using a high intensity UV lamp (FusionUV LH6, D bulb, 100% intensity with 6 passes at 3.5 m/minute).

Poly(ethylene imine) ('PEI,' branched, 10,000 molecular weight, 99%, Alfa Aesar) was applied neat as a thin, even coating over the methacrylate coating and then left at 80° C. for 1 hour. After this the excess PEI was removed by washing water and then 2-propanol with gentle wiping of the surface to help remove any residues. After drying a hard surface was retained but was far more hydrophilic than the methacrylate coating with FT-IR spectroscopy showing spectral changes consistent with the addition of PEI.

To convert available amine groups present on the attached PEI chains to thionourea collector groups an even coating of ethoxy carbonyl isothiocyanate (ECITC) was then spread over the panel and left at room temperature for 45 minutes. Excess ECITC was wiped off the surface and the surface was then cleaned thoroughly in 2-propanol and dried.

The coated panel was placed in a horizontal testing jig that could expose the sample to a slurry over an area of ~112 $cm^2$, 2.0 cm depth. A body of mineral containing chalcopyrite as the major component (42% w/w) with the remainder a mixture of mostly iron sulphides (Pyrrhotite 20% w/w), (Pyrite 16% w/w), was ground in a ball mill to a size fraction of less than 106 μm (particle size distribution D10[5.68 μm] D50[37.29 μm], D90[106.9 μm]). 2.0 g of this mineral powder was added to 200 ml of deionised water to make a slurry that was thoroughly dispersed before adding to the test jig that contained the sample panel. The test jig was left stationary for 20 minutes after which the excess mineral was poured away and the mineral adhered to the polymer surface collected using filtration from a mineral concentrate. The mineral collected was thoroughly dried and weighed. This test was repeated several times, with an average taken of the weight of collected mineral per unit area of polymer surface and gave an increase of approximately 110% in weight of mineral collected compared to a reference polymer made with poly(N,N-diallylhexanamide-o-N,N,N',N'-tetraallylethanediamide).

Example 14 Collection of a Chalcopyrite Rich Mineral Using a Thiocarbamate Functionalised methacrylate polymer poly(O-ethyl O-(3-methyl-2-oxobut-3-en-1-yl) imidothiodicarbonate)

2-Hydroxy ethyl methacrylate (Aldrich, 14.9 g, 0.114 mol) and THF (28 g) were charged to a round bottomed flask equipped with magnetic stirrer bar, condenser and nitrogen inlet. 4-Methoxyphenol (0.23 g, 0.0019 mol) was charged to flask. Ethoxycarbonyl isothiocyanate (Alfa Aesar, 97%15.5 g, 0.118 mol) was gradually charged to the flask. The reaction mixture was heated at 62° C. for 16 h then refluxed for 3 h. A further portion of 2-hydroxy ethyl metharylate (0.5 g g, 0.004 mol) was charged and reflux was maintained for 4 h.

A portion of the reaction mixture (14.4 g) was treated with water (80 ml) and sodium hydroxide (0.07 g, 1.75 mmol) at 60° C. for 4 h. DCM (160 ml) was added to the reaction mixture, the layers were then separated and the aqueous layer was further extracted with DCM (160 ml). The DCM solution was dried ($MgSO_4$), filtered and stripped. This gave 6.6 g of an oil (21%). The remaining reaction mixture (44.5 g) was treated in a similar manner with water (247 ml) and sodium hydroxide (0.2 g). The reaction mixture was extracted with DCM (2×250 ml), dried ($MgSO_4$) and stripped. Toluene (2×50 ml) was added to the stripped oil and stripped this gave the monomer O-ethyl O-(3-methyl-2-oxobut-3-en-1-yl) imidothiodicarbonate as an oil (23.6 g. overall 30.2 g, 98%).

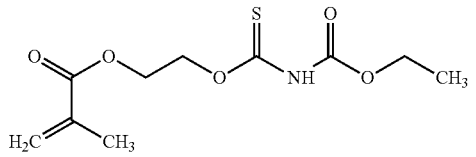

O-ethyl O-(3-methyl-2-oxobut-3-en-1-yl)imidothiodicarbonate

FTIR (Film): 3517, 3259, 2982, 1770, 1720, 1636, 1521, 1251, 1232, 1171, 1097, 948, 769 $cm^{-1}$.

$^1H$ NMR ($CDCl_3$): 1.25 (t, 3.1H), 1.95 (s, 3H), 4.2 (q, 1.9H), 5.15 (m, 4.2H), 4.3 (m, 0.3H, imp), 4.45 (t, 2.2H), 2.25 (t, 1.9H), 5.1 (s, 1H), 6.15 (s, 1H), 8.25 (br, 0.9H).

MS ($CH_2Cl_2$): $C_{10}H_{15}NO_5S$ requires 261.0671; found 261.0666.

A mixture containing this thiocaramate functionalised methacrylate monomer (0.747 g), ethyleneglycol dimethacrylate (Alfa-Aesar, 0.752 g) and the photo-intiator rgacure 2022 (0.039 g) was deposited as a thin film, of several grams per square metre coating weight, onto several polycarbonate panels (10 cm×20 cm×2 mm thickness) using a soft roller. The coated panel was placed in a horizontal testing jig that could expose the sample to a slurry over an area of ~15 $cm^2$, 2.0 cm depth. A body of mineral containing chalcopyrite as the major component (42% w/w) with the remainder a mixture of mostly iron sulphides (Pyrrhotite 20% w/w), (Pyrite 16% w/w), was ground in a ball mill to a size fraction of less than 106 μm (particle size distribution D10[5.68 μm], D50[37.29 μm], D90[106.9 μm], D3,2[12.36 μm], D4,3 [46.75 μm]). 2.0 g of this mineral powder was added to 200 ml of deionised water to make a slurry that was thoroughly dispersed before adding to the test jig that contained the sample panel. The test jig was left stationary for 20 minutes after which the excess mineral was poured away and the mineral adhered to the polymer surface collected using filtration from a mineral concentrate. The mineral collected was thoroughly dried and weighed. This test was repeated several times, with an average taken of the weight collected per unit area of polymer surface compared to a reference polymer that did not contain a thiocarbamate group The sample containing the thiocarbamate collector group collected 4.18 mg/$cm^2$ (an increase of 101% in weight of mineral collected compared to a reference polymer made with N,N-diallylhexanamide and N,N-tetraallylethanediamide).

Example 15 Collection of a Chalcopyrite Rich Mineral Using a Functionalised silane polymer poly (ethyl {[3-(triethoxysilane)propyl] carbamothioyl}carbamate) Made by 'sol-gel' Process Synthesis of ethyl {[3-(triethoxysilane)propyl] carbamathioyl}carbamate) monomer (3-Aminopropyl)triethoxysilane (Sigma-Aldrich, >98%, 23.9 g, 0.108 mol) was charged to a flame dried round bottomed flask equipped with magnetic stirrer bar, condenser and nitrogen inlet. 4-Methoxyphenol (0.23 g, 0.0019 mol) was charged to flask. Ethoxycarbonyl isothiocyanate (Alfa Aesar, >97%, 13.8 g, 0.105 mol) was gradually charged to the flask. The reaction mixture was heated at 45-60° C. for 5 h. This gave a clear yellow oil product (32.8 g, 87%) which 94% pure by NMR analysis.

FTIR (Film): 3289, 2975, 2927, 2885, 1713, 1547, 1245, 1097, 994, 948, 768 $cm^{-1}$.

$^1H$ NMR ($CDCl_3$): 0.15 (m, 2H), 1.2 (t, 9H), 1.3 (t, 2.8H), 1.5 (n, 0.1H, sm), 1.75 (quin, 1.9H), 2.7 (m, 0.1H, sm), 3.65 (t, 1.8H), 3.7 (q, 0.3H, sm), 3.8 (q, 5.7H), 4.2 (q, 1.9H), 9.7 (br, 0.9H).

Ethyl {[3-(triethoxysilane)propyl] carbamothioyl}carbamate (0.76 g), acetic acid (pH3.0) (1.01 g) and isopropanol (2.0 g) were mixed together and heated to 50° C. in an oil bath for 6 hours with constant stirring. The solution was cooled to room temperature and left for 24 hours. The mixture was then spread over a 2 mm thick 10 cm×20 cm poly(carbonate) plaque as a 1 mm layer over the whole surface. This was placed into a flat-based glass container, sealed by placing a glass lid on top and placed into an oven at 50° C. for a further 6 hours. The sample was then cooled and left at ambient for a further 18 hours with the lid partially open. The sample was reheated to 50° C. still within the partially opened chamber for a further 6 hours and then left to cool to ambient and stored at this temperature for 5 days. The sample was then placed in a glass container with no lid for a further 3 hours at 50° C. and left to cool to produce a hard clear coating.

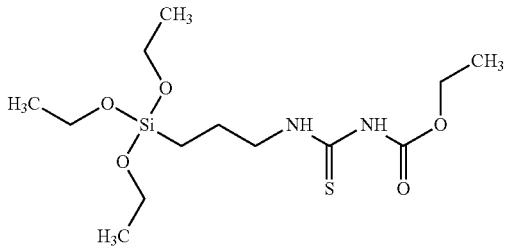

ethyl {[3-(triethoxysilane)propyl] carbamothioyl}carbamate

The coated panel was placed in a horizontal testing jig that could expose the sample to a slurry over an area of ~15 $cm^2$, 2.0 cm depth. A body of mineral containing chalcopyrite as the major component (42% w/w) with the remainder a mixture of mostly iron sulphides (Pyrrhotite 20% w/w), (Pyrite 16% w/w), was ground in a ball mill to a size fraction of less than 106 m (particle size distribution D10[5.68 μm] D50[37.29 μm], D90[106.9 μm]). 2.0 g of this mineral powder was added to 200 ml of deionised water to make a slurry that was thoroughly dispersed before adding to the test jig that contained the sample panel. The test jig was left stationary for 20 minutes after which the excess mineral was poured away and the mineral adhered to the polymer surface collected using filtration from a mineral concentrate. The mineral collected was thoroughly dried and weighed. This test was repeated several times, with an average taken of the weight collected per unit area of polymer surface compared to a reference polymer that did not contain a thionourea group (see reference sample)

The sample containing the thionourea collector group gave an increase of over twice weight of mineral collected compared to a reference polymer made with N,N-diallylhexanamide replacing N,N,N,N'-tetraallylethanediamide.

Example 16 Collection of Cobalt Sulphide (CoS) Using a Copolymer Consisting of poly(N,N-diallyl ethoxycarbonyl thionourea-co-N,N,N',N'-tetraallyl ethanediamide)

A coated panel was prepared and placed in a horizontal testing jig in accordance with Example 8. 2.0 g of cobalt sulfide (CoS) with an average particle size of ~150 μm (−100 mesh) was added to 200 ml of deionised water to make a slurry that was thoroughly dispersed before adding to the test jig that contained the sample panel. The test jig was left stationary for 20 minutes after which the excess mineral was poured away and the mineral adhered to the polymer surface collected using filtration from a mineral concentrate. The mineral collected was thoroughly dried and weighed. This test was repeated several times, with an average taken of the weight collected per unit area of polymer surface. This was compared to cobalt disulphide collected from a reference polymer that was made using the same method and test conditions but with N,N-diallylhexanamide used to replace the N,N-diallylthionourea monomer.

The sample containing the thionourea collector group gave an increase of 65% in weight of the cobalt sulfide collected compared to the reference polymer.

Example 17 Collection of Iron Disulphide Mineral (Pyrite) Using a Xanthogen Formate Containing Copolymer, poly((2-(2-(2-(2-ethylethoxy xanthogen formate)ethoxy)ethoxy)ethyl-N,N-diallylcarbamate-co-N,N,N',N'-tetraallylethanediamide)

A coated panel was prepared and placed in a horizontal testing jig in accordance with Example 9. 2.0 g of iron disulphide of particle size less than 106 μm was added to 200 ml of deionised water to make a slurry that was thoroughly dispersed before adding to the test jig that contained the sample panel. The test jig was left stationary for 20 minutes after which the excess mineral was poured away and the mineral adhered to the polymer surface collected using filtration from a mineral concentrate. The mineral collected was thoroughly dried and weighed. The sample showed a collection of 1.85 mg/cm$^2$ of iron pyrite.

Example 18 Collection of Chalcopyrite Mineral Using Chalcopyrite Pre-Treated with an Amine Functionalised Thionocarbamate Collector with Subsequent Reaction to a Cellulose Surface Modified with Tosyl Ester Functionality

Description

This experiment utilises a solid surface with a different functional chemistry to combine with a chalcopyrite particle pre-treated with a reactive, functionalised collector. The mechanism then consists of:

(1) Attachment of collector to chalcopyrite in solution (as in froth flotation)

(2) Attachment of collector present on chalcopyrite to an active group on the collecting solid surface This scheme uses a collector that contains a thionocarbamate on one end of the collector molecule to bond to chalcopyrite with an amine on the other end to bond to a tosyl ester group on a modified cellulose surface. Treatment of chalcopyrite with the collector was performed separately to the attachment of the mineral to the solid surface.

Experiment

Preparation of the Collector Molecule

Ethoxycarbonyl isothiocyanate (51 g) in dichloromethane (10 ml) was charged into 50 ml 3-necked flask and cooled to 10° C. 2-dimethylaminoethanol (3.68 g) in dichloromethane (1 ml) was added drop-wise with stirring over 10 minutes. The reaction was then allowed to reach room temperature, after which more dichloromethane was added (30 ml) with stirring maintained for a further 2 hours. Volatiles were then removed using a rotary evaporator to yield a thick yellow oil. Yield >90%.

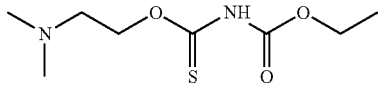

'Collector-collector' molecule $^1$H NMR (500 MHz, $CDCl_3$) δ/ppm=1.3 (t), 2.85 (s), 2.95 (s), 3.4 (t), 4.2 (q), 4.5 (t)

Preparation of the Chalcopyrite with Collector

A ground chalcopyrite sample (approx. 20 g, ~16% Cu, <106 n) was introduced to a dilute solution of and the above amine functionalised collector molecule (~0.3 g) in deionised water (200 ml). The mixture was heated to approximately 40° C. and then gently stirred for 30 minutes. The chalcopyrite was filtered and then washed 4 times by removing the chalcopyrite and reintroducing to 200 ml of water with stirring for each cleaning step. The treated chalcopyrite was then dried at 60° C. to produce a green powder, similar in appearance to the mineral initially used.

Preparation of the Modified Cellulose Surface to Collect Chalcopyrite/Collector

A mixture of toluene (100 ml), pyridine (15 ml) and tosyl chloride (0.5 g) was heated to approximately 80° C. in a flat bottomed glass tank. A cellulose filter paper (Whatman no. 2, approx. 8 cm dia.) was dried then introduced to the mixture and the tank then sealed. The paper was left for 45 minutes with periodic gentle mixing of the solution.

The paper was then retrieved, washed in toluene and then acetone thoroughly to remove all residues. The sample was then dried at 55° C. for 30 minutes.

Treatment of the Modified Cellulose with the Chalcopyrite/Collector

The treated cellulose filter paper was then introduced to a slurry containing 2.0 g of treated chalcopyrite in 200 ml of water was introduced to a 2 litre glass beaker with the slurry kept in suspension during addition of the paper. The paper was placed at the bottom of the beaker with the suspension allowed to settle onto the paper. The mixture was then heated to 70-80° C. for one hour after which the paper was gently extracted from the mixture so that a thin layer of mineral remained attached to the surface.

The chalcopyrite that remained on the filter paper was removed by washing the chalcopyrite off the paper in water and re-filtration of the chalcopyrite, which was then thoroughly dried and analysed by XRF.

This experiment was repeated but with slightly more mineral left on the paper after extraction.

Results

XRF analysis showed an average of 18.03% Cu present in the extracted mineral from the modified cellulose. When the experiment was repeated with a slightly thicker layer of collected mineral a value of 17.33% Cu was attained. This was significantly greater than the copper concentration of 16.16% present in the original mineral feedstock.

Example 19 Reference Experiment for Collection of Chalcopyrite Mineral Using Chalcopyrite Pre-Treated with an Amine Functionalised Thionocarbamate Collector onto a Cellulose Surface Description This experiment provides a reference test for the collection of chalcopyrite onto a modified cellulose surface. The experiment was identical to the one that utilises an amine functionalised thionocarbamate collector group except that the cellulose surface was not treated to contain tosyl ester.

Results

XRF analysis showed an average of 15.94% copper present in the extracted mineral from the unmodified cellulose paper. This was similar to the copper concentration of 16.17% present in the original mineral feedstock.

Example 20 Collection of Chalcopyrite from a Mixture of Separately Ground Chalcopyrite and are Body Using a Copolymer Consisting of poly(N,N-diallyl ethoxycarbonyl thionourea-co-N,N,N',N'-tetraallyl ethanediamide)

A coated panel was prepared and placed in a horizontal testing jig in accordance with Example 8. A mineral used for the slurry comprised of a mixture of chalcopyrite (>80% by weight) with a ground ore body that comprised mostly of silicates with approximately 1% chalcopyrite by weight in a ratio of 60:40 chalcopyrite: ore body respectively (particle size distribution D10[5.93 m], D50[33.06 μm], D90[104 μm] D3,2[15.89 μm], D4,3[44.55 μm]). 2.0 g of this mineral powder was added to 200 ml of deionised water to make a slurry that was thoroughly dispersed before adding to the test jig that contained the sample panel. The test jig was left stationary for 20 minutes after which the excess mineral was poured away and the mineral adhered to the polymer surface collected using filtration from a mineral concentrate. The mineral collected was thoroughly dried and weighed. This test was repeated several times, with an average taken of the weight collected per unit area of polymer surface.

The mineral collected from the thionourea containing polymer group showed an increase in copper level of 12.7% using X-Ray fluorescence spectroscopy compared to the original mineral feedstock with a particle size distribution D10[8.04 μm], D50[45.03 μm], D90[112.53 μm], D3,2 [20.45 μm], D4.3[53.51 μm].

Example 21 Collection of Chalcopyrite from a Mixture of Separately Ground Chalcopyrite and are Body Using a Copolymer Consisting of poly(2-(2-(2-(2-ethylethoxy xanthogen formate)ethoxy) ethoxy)ethyl-N,N-diallylcarbamate-co-N,N,N',N'-tetraallyl ethanediamide)

A coated panel was prepared and placed in a horizontal testing jig in accordance with Example 9. A mineral used for the slurry comprised of a mixture of chalcopyrite (approx. 80% purity) with a ground ore body that comprised mostly of silicates (only ~1% chalcopyrite by weight) in a ratio of 60:40 ratio of chalcopyrite:ore body respectively (particle size distribution D10[5.61 μm]D50[26.68 μm], D90[96.38 μm], D3,2[14.82 μm], D4,3[46.83 μm]). 2.0 g of this mineral powder was added to 200 ml of deionised water to make a slurry that was thoroughly dispersed before adding to the test jig that contained the sample panel. The test jig was left stationary for 20 minutes after which the excess mineral was poured away and the mineral adhered to the polymer surface collected using filtration from a mineral concentrate. The mineral collected was thoroughly dried and weighed. This test was repeated several times, with an average taken of the weight collected per unit area of polymer surface.

The mineral collected from the polymer containing the xanthogen formate group showed an increase in copper level of 16.5% using X-Ray fluorescence spectroscopy compared to the original mineral feedstock with a particle size distribution of D10[8.52 μm] D50[46.50 μm], D90[112.69 μm], D3,2[21.36 μm], D4.3[54.58 μm].

The invention claimed is:

1. A method of processing a mixture of minerals including the steps of:

(a) providing a mixture of minerals which includes a metal containing mineral and one or more unwanted gangue minerals;

(b) achieving a contact between the mixture of minerals and polymeric material that includes a mineral binding moiety which selectively binds to the metal containing mineral;

(c) separating the gangue minerals and the polymeric material which has the metal containing mineral bound thereto; and (d) releasing the metal containing mineral from the polymeric material, wherein step b) includes the substeps of:

i) introducing a collector compound to the mixture of minerals, wherein the collector compound includes the mineral binding moiety and a polymer attachment moiety;

ii) selectively binding the collector compound to the metal containing mineral; and iii) attaching the collector compound to a polymer using the polymer attachment moiety; in which in sub-step iii) the collector compound is attached to the polymer by a covalent bond formed by a $SN_2$ nucleophilic reaction between the polymer attachment moiety and a surface group of the polymer;

wherein the polymeric material includes either a methacrylate polymer or a silane polymer.

2. A method according to claim 1, wherein the metal containing mineral contains copper.

3. A method of processing a mixture of minerals including the steps of:

(a) providing a mixture of minerals which includes a metal containing mineral and one or more unwanted gangue minerals;

(b) achieving a contact between the mixture of minerals and polymeric material that includes a mineral binding moiety which selectively binds to the metal containing mineral;

(c) separating the gangue minerals and the polymeric material which has the metal containing mineral bound thereto; and (d) releasing the metal containing mineral from the polymeric material, wherein step b) includes the substeps of:

i) introducing a collector compound to the mixture of minerals, wherein the collector compound includes the mineral binding moiety and a polymer attachment moiety;

ii) selectively binding the collector compound to the metal containing mineral; and iii) attaching the collector compound to a polymer using the polymer attachment moiety; in which in sub-step iii) the collector compound is attached to the polymer by a covalent bond formed by a $SN_2$ nucleophilic reaction between the polymer attachment moiety and a surface group of the polymer;

wherein the polymeric material includes a polymer formed by polymerising a polymeric precursor which includes a group of sub-formula (I)

[I]

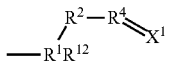

where $R^1$ is i) $CR^a$, where $R^a$ is hydrogen or alkyl, ii) a group $N^+R^{13}$ $(Z^{m-})_{1/m}$, $S(O)_pR^{14}$, or $SiR^{15}$ where $R^{13}$ is hydrogen, halo, nitro, or hydrocarbyl, optionally substituted or interposed with functional groups, $R^{14}$ and $R^{15}$ are independently selected from hydrogen or hydrocarbyl, Z is an anion of charge m, p is 0, 1 or 2 and q is 1 or 2, iii) C(O)N, C(S)N, $S(O)_2N$, C(O)ON, $CH_2ON$, or $CH{=}CHR^cN$ where $R^c$ is an electron withdrawing group, or iv) OC(O)CH, C(O)OCH or $S(O)_2CH$; in which $R^{12}$ is selected from hydrogen, halo, nitro, hydrocarbyl, optionally substituted or interposed with functional groups, or $R^3{-}R^5{=}Y^1$;

$R^2$ and $R^3$ are independently selected from $(CR^7R^8)n$, or a group $CR^9R^{10}$, $CR^7R^8CR^9R^{10}$ or $CR^9R^{10}CR^7R^8$ where n is 0, 1 or 2, $R^7$ and $R^8$ are independently selected from hydrogen or alkyl, and either one of $R^9$ or $R^{10}$ is hydrogen and the other is an electron withdrawing group, or $R^9$ and $R^{10}$ together form an electron withdrawing group;

$R^4$ and $R^5$ are independently selected from CH or $CR^{11}$ where $CR^{11}$ is an electron withdrawing group, the dotted lines indicate the presence or absence of a bond, $X^1$ is a group $CX^2X^3$ where the dotted line bond to which it is attached is absent and a group $CX^2$ where the dotted line to which it is attached is present, $Y^1$ is a group $CY^2Y^3$ where the dotted line to which it is attached is absent and a group $CY^2$ where the dotted line to which it is attached is present; and $X^2$,$X^3$,$Y^2$ and $Y^3$ are independently selected from hydrogen, fluorine or other substituents.

4. A method according to claim 1 in which the polymeric material includes a polymer formed by polymerising a polymeric precursor that is a compound of structure [X]

[X]

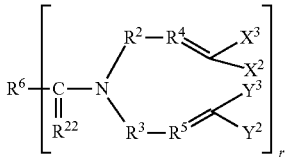

where $R^2$ and $R^3$ are independently selected from $(CR^7R^8)_n$, or a group $CR^9R^{10}$, $CR^7R^8CR^9R^{10}$ or $CR^9R^{10}CR^7R^8$, where n is 0, 1 or 2, $R^7$ and $R^8$ are independently selected from hydrogen or alkyl, and either one of $R^9$ or $R^{10}$ is hydrogen and the other is an electron withdrawing group, or $R^9$ and $R^{10}$ together form an electron withdrawing group;

$R^4$ and $R^5$ are independently selected from CH or $CR^{11}$ where $CR^{11}$ is an electron withdrawing group;

$R^6$ is one or more of a bridging group, an optionally substituted hydrocarbyl group, a perhaloalkyl group, a siloxane group, an amide, or a partially polymerised chain containing repeat units, $R^{22}$ is 0 or S, and $R^6$ includes the mineral binding moiety, or in conjunction with $C{=}R^{22}$ forms the mineral binding moiety;

$X^2$, $X^3$, $Y^2$, and $Y^3$ are independently selected from hydrogen, fluorine or other substituents; and r is 1, 2, 3 or 4.

5. A method according to claim 4 in which the mineral binding moiety is a thionocarbamate, thiourea, thiol, thiocycloalkane, thiophosphate or xanthogen formate containing functional group.

6. A method according to claim 5 in which the polymeric precursor is a compound of structure [XI]

[XI]

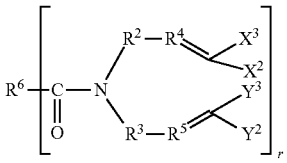

where $R^6$ contains the group —NHC(S)O—, —C(O)NHC(S)O— or —O—C(S)SC(O)O—.

7. A method according to claim 6 in which the polymeric precursor is a compound of structure [XII]

[XII]

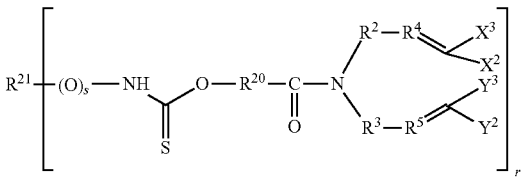

where $R^{20}$ and $R^{21}$ are each independently an alkyl group, optionally substituted or interposed with functional groups, preferably having one to twenty carbon atoms, most preferably having two to twelve carbon atoms, s is 0 or 1, and r is preferably 1 or 2, or a pre-polymer obtained by pre-polymerisation of said compound.

8. A method according to claim 6 in which the polymeric precursor is a compound of structure [XIII]

[XIII]

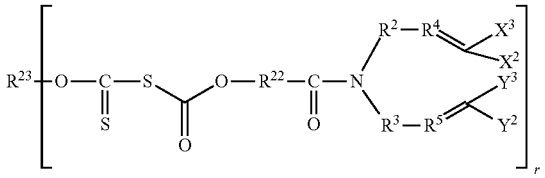

where $R^{22}$ and $R^{23}$ are each independently an alkyl group, optionally substituted or interposed with functional groups, preferably interposed with 0, and preferably have one to twenty carbon atoms, most preferably two to twelve carbon atoms, and r is preferably 1 or 2, or a pre-polymer obtained by pre-polymerisation of said compound.

9. A method according to claim 4 in which the polymeric precursor is a compound of structure [XIV]

[XIV]

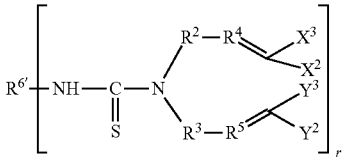

where $R^{6'}$—NH constitutes $R^6$, and $R^{6'}$ in combination with —NH—CS forms the mineral binding moiety.

10. A method according to claim 9 in which the polymeric precursor is a compound of structure [XV]

[XV]

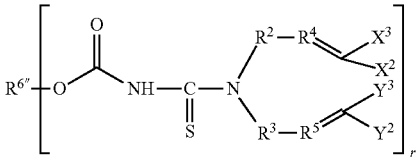

where $R^{6''}$—OC(O)—NH constitutes $R^6$, and $R^{6''}$ in combination with —OC(O)—NH—CS forms the mineral binding moiety.

11. A method according to claim 3 in which the polymer formed by polymerising the polymeric precursor encapsulates the mineral binding moiety.

12. A method according to claim 3 in which the polymer formed by polymerising the polymeric precursor is a homopolymer.

13. A method according to claim 3 in which the polymer is a copolymer produced by copolymerising the polymeric precursor with one or more other polymeric precursors and/or with a cross-linker.

14. A method of processing a mixture of minerals including the steps of:

(a) providing a mixture of minerals which includes a metal containing mineral and one or more unwanted gangue minerals;

(b) achieving a contact between the mixture of minerals and polymeric material that includes a mineral binding moiety which selectively binds to the metal containing mineral; and (c) separating the gangue minerals and the polymeric material which has the metal containing mineral bound thereto, wherein the polymeric material includes a polymeric substrate having a surface which has the mineral binding moiety attached thereto and the polymeric material includes polymeric chains which are grafted onto the surface of the polymeric substrate, the polymeric chains include the mineral binding moiety, and the polymeric substrate is an epoxide or a diisocyanate having the polymeric chains grafted thereon.

15. A method according to claim 14, wherein the polymeric chains include a polyimine, which is functionalised by attachment of the mineral binding moiety.

16. A method according to claim 14, wherein the mineral binding moiety is a thiourea.

17. A method according to claim 1, wherein the covalent bond is a C—N or C—O bond.

18. A method according to claim 17, wherein either the polymer attachment moiety is an amine functional group or hydroxyl, and the surface group is a leaving group, or the polymer attachment moiety is the leaving group and the surface group is an amine functional group or hydroxyl.

19. A method according to claim 1, wherein the polymer is a hydroxyl methacrylate polymer, including where the hydroxyl methacrylate polymer is modified by converting surface hydroxyl groups to a leaving group, and also including where the leaving group is a tosyl ester.

20. A method according to claim 14, wherein the polymeric material includes a polymer formed by polymerising a polymeric precursor which includes a group of subformula (I)

[I]

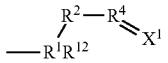

where $R^1$ is i) $CR^a$, where $R^a$ is hydrogen or alkyl, ii) a group $N^+R^{13}(Z^{m-})_{1/m}$, $S(O)_pR^{14}$, or $SiR^{15}$ where $R^{13}$ is hydrogen, halo, nitro, or hydrocarbyl, optionally substituted or interposed with functional groups, $R^{14}$ and $R^{15}$ are independently selected from hydrogen or hydrocarbyl, Z is an anion of charge m, p is 0, 1 or 2 and q is 1 or 2, iii) C(O)N, C(S)N, $S(O)_2N$, C(O)ON, $CH_2ON$, or CH═$CHR^cN$ where $R^c$ is an electron withdrawing group, or iv) OC(O)CH, C(O)OCH or $S(O)_2CH$; in which $R^{12}$ is selected from hydrogen, halo, nitro, hydrocarbyl, optionally substituted or interposed with functional groups, or —$R^3$—$R^5$═$Y^1$;

$R^2$ and $R^3$ are independently selected from $(CR^7R^8)_n$, or a group $CR^9R^{10}$, $CR^7R^8CR^9R^{10}$ or $CR^9R^{10}CR^7R^8$ where n is 0, 1 or 2, $R^7$ and $R^8$ are independently selected from hydrogen or alkyl, and either one of $R^9$ or $R^{10}$ is hydrogen and the other is an electron withdrawing group, or $R^9$ and $R^{10}$ together form an electron withdrawing group;

$R^4$ and $R^5$ are independently selected from CH or $CR^{11}$ where $CR^{11}$ is an electron withdrawing group, the dotted lines indicate the presence or absence of a bond, $X^1$ is a group $CX^2X^3$ where the dotted line bond to which it is attached is absent and a group $CX^2$ where the dotted line to which it is attached is present, $Y^1$ is a group $CY^2Y^3$ where the dotted line to which it is attached is absent and a group $CY^2$ where the dotted line to which it is attached is present; and $X^2$, $X^3$, $Y^2$ and $Y^3$ are independently selected from hydrogen, fluorine or other substituents.

21. A method according to claim 14, wherein the polymeric precursor is a compound of structure [X]

[X]

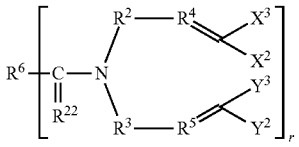

where $R^2$ and $R^3$ are independently selected from $(CR^7R^8)_n$, or a group $CR^9R^{10}$, $CR^7R^8CR^9R^{10}$ or $CR^9R^{10}CR^7R^8$, where n is 0, 1 or 2, $R^7$ and $R^8$ are independently selected from hydrogen or alkyl, and either one of $R^9$ or $R^{10}$ is hydrogen and the other is an electron withdrawing group, or $R^9$ and $R^{10}$ together form an electron withdrawing group;

$R^6$ is one or more of a bridging group, an optionally substituted hydrocarbyl group, a perhaloalkyl group, a siloxane group, an amide, or a partially polymerised chain containing repeat units;

$R^{22}$ is O or S, $R^6$ includes the mineral binding moiety, or in conjunction with $C{=}R^{22}$ forms the mineral binding moiety;

$X^2$, $X^3$, $Y^2$ and $Y^3$ are independently selected from hydrogen, fluorine or other substituents; and r is 1, 2, 3 or 4.

22. A method according to claim 15, wherein the polymeric material includes a polymer formed by polymerising a polymeric precursor which includes a group of sub-formula (I)

[I]

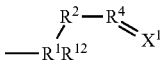

where $R^1$ is i) $CR^a$, where $R^a$ is hydrogen or alkyl, ii) a group $N^+R^{13}(Z^{m-})_{1/m}$, $S(O)_pR^{14}$, or $SiR^{15}$ where $R^{13}$ is hydrogen, halo, nitro, or hydrocarbyl, optionally substituted or interposed with functional groups, $R^{14}$ and $R^{15}$ are independently selected from hydrogen or hydrocarbyl, Z is an anion of charge m, p is 0, 1 or 2 and q is 1 or 2, iii) C(O)N, C(S)N, $S(O)_2N$, C(O)ON, $CH_2ON$, or $CH{=}CHR^cN$ where $R^c$ is an electron withdrawing group, or iv) OC(O)CH, C(O)OCH or $S(O)_2CH$; in which $R^{12}$ is selected from hydrogen, halo, nitro, hydrocarbyl, optionally substituted or interposed with functional groups, or $—R^3—R^5{=}Y^1$;

$R^2$ and $R^3$ are independently selected from $(CR^7R^8)n$, or a group $CR^9R^{10}$, $CR^7R^8CR^9R^{10}$ or $CR^9R^{10}CR^7R^8$ where n is 0, 1 or 2, $R^7$ and $R^8$ are independently selected from hydrogen or alkyl, and either one of $R^9$ or $R^{10}$ is hydrogen and the other is an electron withdrawing group, or $R^9$ and $R^{10}$ together form an electron withdrawing group;

$R^4$ and $R^5$ are independently selected from CH or $CR^{11}$where $CR^{11}$ is an electron withdrawing group, the dotted lines indicate the presence or absence of a bond, $X^1$ is a group $CX^2X^3$ where the dotted line bond to which it is attached is absent and a group $CX^2$ where the dotted line to which it is attached is present, $Y^1$ is a group $CY^2Y^3$ where the dotted line to which it is attached is absent and a group $CY^2$ where the dotted line to which it is attached is present; and $X^2$,$X^3$,$Y^2$ and $Y^3$ are independently selected from hydrogen, fluorine or other substituents.

23. A method according to claim 15, wherein the polymeric precursor is a compound of structure [X]

[X]

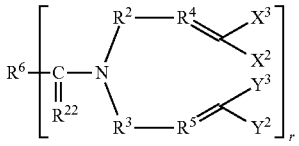

where $R^2$ and $R^3$ are independently selected from $(CR^7R^8)_n$, or a group $CR^9R^{10}$, $CR^7R^8CR^9R^{10}$ or $CR^9R^{10}CR^7R^8$, where n is 0, 1 or 2, $R^7$ and $R^8$ are independently selected from hydrogen or alkyl, and either one of $R^9$ or $R^{10}$ is hydrogen and the other is an electron withdrawing group, or $R^9$ and $R^{10}$ together form an electron withdrawing group; $R^4$ and $R^5$ are independently selected from CH or $CR^{11}$ where $CR^{11}$ is an electron withdrawing group;

$R^6$ is one or more of a bridging group, an optionally substituted hydrocarbyl group, a perhaloalkyl group, a siloxane group, an amide, or a partially polymerised chain containing repeat units;

$R^{22}$ is O or S, and $R^6$ includes the mineral binding moiety, or in conjunction with $C{=}R^{22}$ forms the mineral binding moiety;

$X^2$, $X^3$, $Y^2$ and $Y^3$ are independently selected from hydrogen, fluorine or other substituents; and r is 1, 2, 3 or 4.

24. A method of processing a mixture of minerals including the steps of:

(a) providing a mixture of minerals which includes a metal containing mineral and one or more unwanted gangue minerals;

(b) achieving a contact between the mixture of minerals and polymeric material that includes a mineral binding moiety which selectively binds to the metal containing mineral; and (c) separating the gangue minerals and the polymeric material which has the metal containing mineral bound thereto, wherein the polymeric material includes a polymeric substrate having a surface which has the mineral binding moiety attached thereto and the polymeric material includes polymeric chains which are grafted onto the surface of the polymeric substrate, the polymeric chains include the mineral binding moiety, and the mineral binding moiety is a thiourea; and wherein the polymeric material includes a polymer formed by polymerising a polymeric precursor which includes a group of sub-formula (I)

[I]

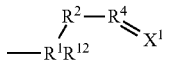

where $R^1$ is i) $CR^a$, where $R^a$ is hydrogen or alkyl, ii) a group $N^+R^{13}(Z^{m-})_{1/m}$, $S(O)_pR^{14}$, or $SiR^{15}$ where $R^{13}$ is hydrogen, halo, nitro, or hydrocarbyl, optionally substituted or interposed with functional groups, $R^{14}$ and $R^{15}$ are independently selected from hydrogen or hydrocarbyl, Z is an anion of charge m, p is 0, 1 or 2 and q is 1 or 2, iii) C(O)N, C(S)N, $S(O)_2N$, C(O)ON, $CH_2ON$, or $CH{=}CHR^cN$ where $R^c$ is an electron withdrawing group, or iv) OC(O)CH, C(O)OCH or $S(O)_2CH$; in which $R^{12}$ is selected from hydrogen, halo, nitro, hydrocarbyl, optionally substituted or interposed with functional groups, or $—R^3—R^5{=}Y^1$;

$R^2$ and $R^3$ are independently selected from $(CR^7R^8)n$, or a group $CR^9R^{10}$, $CR^7R^8CR^9R^{10}$ or $CR^9R^{10}CR^7R^8$ where n is 0, 1 or 2, $R^7$ and $R^8$ are independently selected from hydrogen or alkyl, and either one of $R^9$ or $R^{10}$ is hydrogen and the other is an electron withdrawing group, or $R^9$ and $R^{10}$ together form an electron withdrawing group;

$R^4$ and $R^5$ are independently selected from CH or $CR^{11}$ where $CR^{11}$ is an electron withdrawing group;

the dotted lines indicate the presence or absence of a bond, $X^1$ is a group $CX^2X^3$ where the dotted line bond to which it is attached is absent and a group $CX^2$ where the dotted line to which it is attached is present, $Y^1$ is a group $CY^2Y^3$ where the dotted line to which it is attached is absent and a group $CY^2$ where the dotted line to which it is attached is present; and $X^2$,$X^3$,$Y^2$ and $Y^3$ are independently selected from hydrogen, fluorine or other substituents.

25. A method according to claim 14, wherein the polymeric material includes a polymer formed by polymerising a polymeric precursor that is a compound of structure [X]

[X]

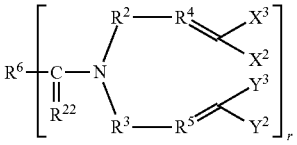

where $R^2$ and $R^3$ are independently selected from $(CR^7R^8)_n$, or a group $CR^9R^{10}$, $CR^7R^8CR^9R^{10}$ or $CR^9R^{10}CR^7R^8$, where n is 0, 1 or 2, $R^7$ and $R^8$ are independently selected from hydrogen or alkyl, and either one of $R^9$ or $R^{10}$ is hydrogen and the other is an electron withdrawing group, or $R^9$ and $R^{10}$ together form an electron withdrawing group; $R^4$ and $R^5$ are independently selected from CH or $CR^{11}$ where $CR^{11}$ is an electron withdrawing group;

$R^6$ is one or more of a bridging group, an optionally substituted hydrocarbylgroup, a perhaloalkyl group, a siloxane group, an amide, or a partially polymerised chain containing repeat units, $R^{22}$ is O or S, $R^6$ includes the mineral binding moiety, or in conjunction with $C{=}R^{22}$ forms the mineral binding moiety;

$X^2$, $X^3$, $Y^2$ and $Y^3$ are independently selected from hydrogen, fluorine or other substituents; and r is 1, 2, 3 or 4.

26. A method according to claim 15, wherein the polyimine is polyethylene imine.

* * * * *